US010766586B2

(12) United States Patent
Wilson et al.

(10) Patent No.: US 10,766,586 B2
(45) Date of Patent: Sep. 8, 2020

(54) RETRACTABLE THRUSTER AND DRIVE SHAFT FOR RETRACTABLE THRUSTER

(71) Applicant: LEWMAR LIMITED, Hampshire (GB)

(72) Inventors: Sean Daniel Wilson, Hampshire (GB); Nicholas Henly, Hampshire (GB)

(73) Assignee: LEWMAR LIMITED, Hampshire (GB)

( * ) Notice: Subject to any disclaimer, the term of this patent is extended or adjusted under 35 U.S.C. 154(b) by 0 days.

(21) Appl. No.: 16/411,947

(22) Filed: May 14, 2019

(65) Prior Publication Data

US 2019/0389549 A1 Dec. 26, 2019

(30) Foreign Application Priority Data

Jun. 22, 2018 (GB) ..... 1810302.8

(51) Int. Cl.
*B63H 5/125* (2006.01)
*B63H 5/14* (2006.01)
*B63H 25/42* (2006.01)

(52) U.S. Cl.
CPC ..... *B63H 5/125* (2013.01); *B63H 5/14* (2013.01); *B63H 25/42* (2013.01)

(58) Field of Classification Search
CPC ..... B63H 25/00; B63H 25/42; B63H 5/125; B63H 5/14; F16C 3/00; F16C 3/03
(Continued)

(56) References Cited

U.S. PATENT DOCUMENTS 1,385,130 A 7/1921 Hooke
6,241,616 B1 6/2001 Lightcap
(Continued)

FOREIGN PATENT DOCUMENTS

CN 203946264 U 11/2014
DE 19601226 A1 7/1997
(Continued)

OTHER PUBLICATIONS

British Search Report in corresponding British Patent Application No. GB 1810302.8 dated Apr. 5, 2019. 4 pages.
(Continued)

*Primary Examiner* — Lars A Olson
(74) *Attorney, Agent, or Firm* — Leason Ellis LLP

(57) ABSTRACT

A retractable thruster assembly for a marine vessel has a propeller unit, a motor, a housing and a drive shaft linking the motor with the propeller unit. An actuator is operable to move the propeller unit from the storage configuration to a deployment configuration in a direction from inboard to outboard, the propeller unit being extended from the hull for use in the deployment configuration. The drive shaft comprises a motor-side universal joint for attachment to the motor and a propeller-side universal joint for attachment to the propeller unit. The universal joints permit folding of the drive shaft at least in the storage configuration. A motor-side telescopic section is disposed adjacent the motor-side universal joint. A propeller-side telescopic section is disposed adjacent the propeller-side universal joint. An intermediate telescopic section is disposed between the motor-side telescopic section and the propeller-side telescopic section.

15 Claims, 17 Drawing Sheets

(58) Field of Classification Search
USPC ..... 440/53, 57, 60, 61 S; 464/162
See application file for complete search history.

(56) References Cited

U.S. PATENT DOCUMENTS

| | | | | |
|---|---|---|---|---|
| 6,247,979 | B1 * | 6/2001 | Rigby ..... | B63H 20/22 440/53 |
| 10,005,532 | B2 | 6/2018 | Smith et al. | |
| 2003/0083136 | A1 | 5/2003 | Park | |
| 2003/0202846 | A1 | 10/2003 | Breese | |
| 2003/0232656 | A1 | 12/2003 | Dutkiewicz et al. | |
| 2006/0060127 | A1 | 3/2006 | Fontanille et al. | |
| 2013/0143678 | A1 | 6/2013 | Smith | |
| 2018/0091089 | A1 | 3/2018 | Lange et al. | |

FOREIGN PATENT DOCUMENTS

| | | | |
|---|---|---|---|
| EP | 1512623 | | 3/2005 |
| EP | 2548797 | | 1/2013 |
| EP | 2548797 | A1 | 1/2013 |
| EP | 2757037 | A1 | 7/2014 |
| EP | 3168137 | | 5/2017 |
| GB | 2092974 | A | 8/1982 |
| GB | 2544467 | A | 5/2017 |
| KR | 20150016452 | | 2/2015 |
| WO | 9813257 | A1 | 4/1998 |

OTHER PUBLICATIONS

British Search Report in corresponding British Patent Application No. GB 1519998.7 dated Mar. 30, 2016. 4 pages.
British Search Report in corresponding British Patent Application No. GB 1519998.7 dated May 6, 2016. 4 pages.
Canadian Examination Search Report in corresponding Canadian Patent Application No. 2,948,025 dated Sep. 21, 2018. 3 pages.
European Extended Search Report in corresponding European Patent Application No. 16198031.3 dated Apr. 7, 2017. 8 pages.
No Author. "Thrusters." Lewmar Marine Equipment Guide. Lewmar Ltd., 2010. 13 pages.

* cited by examiner

Fig. 12A
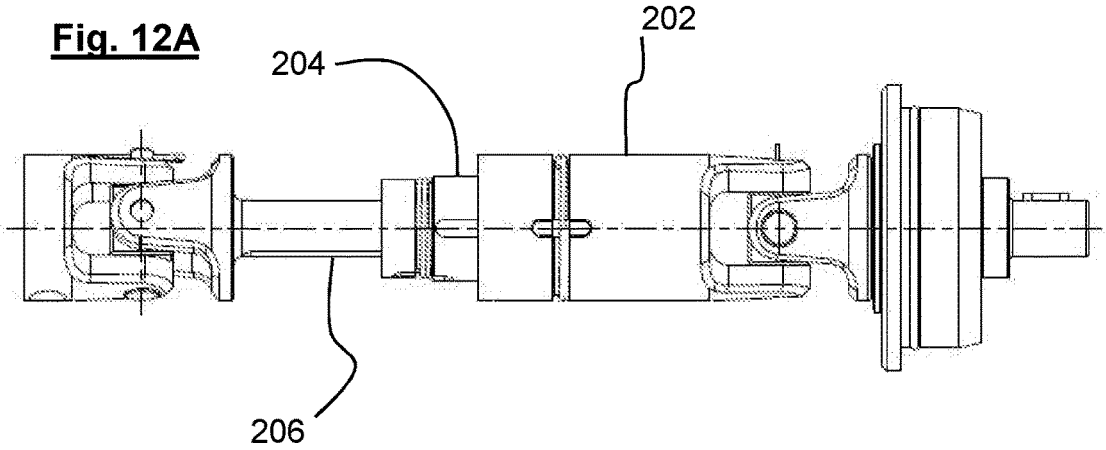
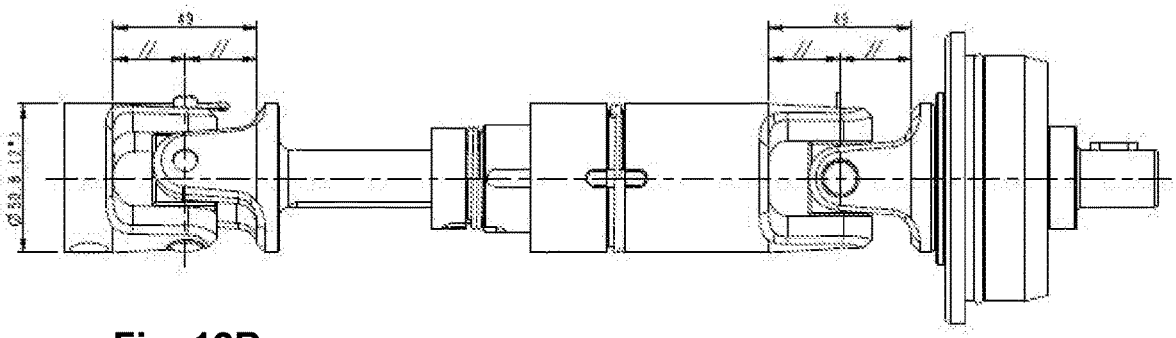
Fig. 12B
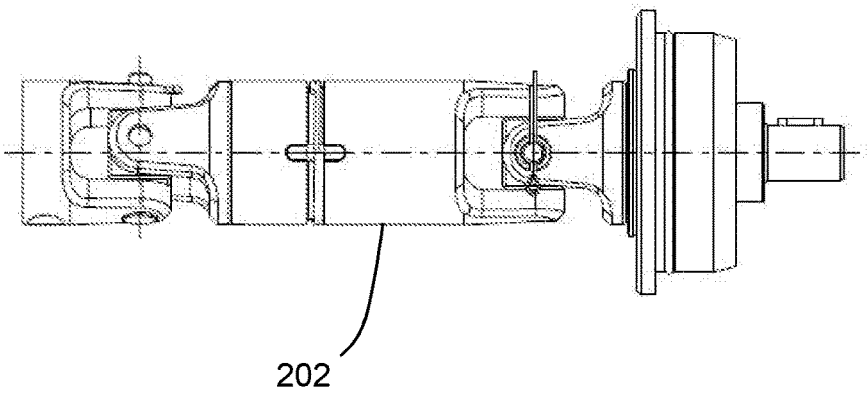
Fig. 13

RETRACTABLE THRUSTER AND DRIVE SHAFT FOR RETRACTABLE THRUSTER

CROSS-REFERENCE TO RELATED PATENT APPLICATIONS

The present application claims priority under 35 U.S.C. § 119 to GB Patent Application No. 1810302.8, filed Jun. 22, 2018, the entire contents of which is hereby incorporated by reference as if expressly set forth in its respective entirety herein.

BACKGROUND TO THE INVENTION

Field of the Invention

The present invention relates to the field of thrusters for marine vessels, such as power boats and sailboats, typically used as leisure craft. More particularly, it relates to thrusters that are able to move between a deployed position when in use, and a retracted position when not in use. In the art, these thrusters have previously been known as 'swing' thrusters, but are more properly referred to as retractable thrusters.

Related Art

It is known that addition of thrusters to marine vessels improves their manoeuvrability. This is of particular advantage when, for example, manoeuvring within a port or harbour, where space is often limited, and manoeuvring takes place at low speed.

Thrusters use a pair of cooperating propellers, driven by an electric or hydraulic motor, in order to provide a thrust of water in the required lateral direction.

Various types of thruster are known in the art already. Bow thrusters are used to control lateral movement of the bow. One type of bow thruster is a tunnel thruster, in which a tunnel is installed laterally through the bow region of the hull. Tunnel thrusters are generally used for larger vessels. The tunnel is installed in the hull below the waterline. This takes up a large amount of internal space and so this approach is not considered suitable for smaller vessels where hull space is often limited.

For smaller vessels, or for vessels having a hull designed for planing, in which the bow part of the hull may have a very shallow draft, an alternative approach lies in a retractable thruster. A retractable thruster is held within the hull when not in use, in a storage configuration, in order to avoid effects of drag. The retractable thruster is extended outboard from the hull when needed, in a deployment configuration. It is in view of the type of motion employed to deploy the thruster that some such thrusters have previously been referred to as 'swing' thrusters.

Known retractable thrusters have the propellers located in a tunnel, the propellers being mounted on a common shaft in the tunnel, the common shaft being connected by a drive shaft to a motor (typically electric but optionally hydraulic) and a deployment mechanism for moving the tunnel with its associated propellers and the drive shaft between the storage and deployment configurations. Typically, the deployment mechanism includes an actuator.

EP-B-1512623 discloses a steering device comprising a propeller unit attached at a first end of a main carrying arm, and a motor attached at a second end of the main carrying arm. The main carrying arm is arranged to pivot through a recess in a rigid housing. In operation, therefore, both the motor and the propeller unit rotate between the storage and deployment configurations. In order to accommodate this movement, a flexible sealing ring is provided between the main carrying arm and the housing.

EP-B-2548797 discloses a retractable thruster comprising a propeller unit arranged for moving along an arc about a first centre of rotation between a retracted and an extended position. A door is attached to the propeller unit. The door is arranged to be rotated about a second centre of rotation opposite to that of the rotation of the propeller unit. EP-B-2548797 also provides a motor which is fixed in an upright position relative to the hull of the vessel. The drive shaft linking the motor and propeller unit has a foldable double cardan joint in order to accommodate the movement of the propeller unit relative to the motor.

EP-A-3168137 also discloses a retractable thruster.

SUMMARY OF THE INVENTION

The present disclosure is based on the retractable thruster of EP-A-3168137 and aims to provide a further improved retractable thruster.

As for EP-A-3168137, it is desirable that a retractable thruster should have a low profile in the hull of the vessel, both in the storage configuration and in the deployment configuration. The motor, the deployment mechanism and the propeller unit should take up as small amount of space inside the hull as possible, and in particular as small amount of height as possible. It is considered to be advantageous for the position of the motor to be fixed. Otherwise, where there is a need to accommodate movement of the motor, e.g. between the storage and deployment configurations, there must be available space to accommodate that movement. Furthermore, the movement of a relatively bulky component such as a motor represents a health and safety consideration. Moreover, movement of the motor and its associated wiring presents the risk of increased wear and tear and thus failure.

In EP-A-3168137, it was disclosed that special consideration should be given to the path of travel of the propeller unit between the storage and deployment configurations. This is necessary in order to ensure that the shape of the hull is suitable or can be adapted accordingly. It is particularly advantageous to ensure that there is suitable clearance between the hull and the path of travel of the propeller unit, without the need for a severe chamfer being applied to the hull.

The present invention has been devised in order to provide a further improved compact storage configuration for the retractable thruster, particularly for higher powered retractable thrusters, while still providing a suitable deployed configuration for the retractable thruster.

In a general aspect, the present invention adapts the approach taken in EP-A-3168137 to use a foldable and telescopic drive shaft comprising at least three telescoping sections.

In a first preferred aspect, the present invention provides a retractable thruster assembly for a marine vessel comprising:

- a propeller unit,
- a motor,
- a drive shaft linking the motor with the propeller unit to drive the propeller unit,
- a housing for locating the propeller unit in a storage configuration, the motor being fixed with respect to the housing, the housing being adapted to be fixed with respect to an opening in a hull of the marine vessel,
- an actuator operable to move the propeller unit from the storage configuration to a deployment configuration in a direction from inboard to outboard, the propeller unit being extended from the hull for use in the deployment configuration, wherein the drive shaft comprises a motor-side universal joint for attachment to the motor and a propeller-side universal joint for attachment to the propeller unit, the motor-side universal joint and the propeller-side universal joint permitting folding of the drive shaft at least in the storage configuration, the drive shaft further comprising:

a motor-side telescopic section disposed adjacent the motor-side universal joint;

a propeller-side telescopic section disposed adjacent the propeller-side universal joint;

at least one intermediate telescopic section disposed between the motor-side telescopic section and the propeller-side telescopic section, wherein the motor-side telescopic section, the intermediate telescopic section and the propeller-side telescopic section are substantially coaxial and slidable relative to each other to accommodate an increase in distance between the propeller unit and the motor when the propeller unit is moved from the storage configuration to the deployment configuration, the drive shaft being capable of transmitting torque from the motor to the propeller unit via the motor-side telescopic section, the intermediate telescopic section and the propeller-side telescopic section at least when the propeller unit is in the deployment configuration.

In a second preferred aspect of the present invention, there is provided a method for installing a retractable thruster assembly according to the first aspect into a marine vessel, the method including the step of providing an opening in a hull of the marine vessel and fixing the housing of the retractable thruster assembly with respect to the opening.

In a third preferred aspect of the present invention, there is provided a kit of parts, comprising a retractable thruster assembly according to the first aspect, and an insert unit, the insert unit being for installation at a corresponding hole formed in a hull of a marine vessel, the insert unit and the housing being adapted to be sealingly attached to each other.

As in EP-A-3168137, it is preferred that the propeller unit moves from the storage configuration to the deployment configuration by pivoting about a pivot axis which is located in a more outboard direction, or closer to the hull, than previously used. This permits the movement of the propeller unit to interfere with the hull design in a more limited manner than previously, and also allows the assembly to take up less space in the hull.

Preferably, the propeller unit is supported by a support assembly which is pivotable relative to the housing about a pivot axis.

Considering that the drive shaft defines a drive path between the motor and the propeller unit, a closest point on the drive path may be defined as a point on the drive path which is closest to the pivot axis. The pivot axis may be located in a position which is outboard of the closest point on the drive path, when the propeller unit is in the storage configuration and when the propeller unit is in the deployment configuration. By the location of the pivot axis in this way relative to the drive path, the thruster assembly can be provided with a low profile, due to the low pivot design relative to the hull.

For a non-foldable, straight drive shaft, the "drive path" would be coincident with the axis of rotation of the drive shaft. For a foldable drive shaft, the drive path is considered to lie along a line joining the centre of rotation of each component piece of the foldable drive shaft. The drive path lies along the principal axis of the coaxial motor-side telescopic section, the intermediate telescopic section and the propeller-side telescopic section.

The pivot axis position is defined relative to the closest point on the drive path for a particular position of the drive shaft. That is, for a particular position of the drive shaft, the drive path can be plotted, and the closest point on the drive path to the pivot axis can be determined for that position of the drive shaft.

It will be understood that the drive path defined by the drive shaft is independent of the diameter of the drive shaft. The drive shaft moves and changes shape and length as the thruster moves from the storage configuration to the deployment configuration, and so the drive path correspondingly moves, with the drive shaft, between the storage and the deployment configurations.

The terms 'inboard' and 'outboard' are used here in a relative sense. A position is 'inboard' when that position is within the hull of the vessel. A position is 'outboard" when that position is outside the hull of the vessel. However, a position can be defined as 'outboard' of or 'more outboard than' another position, meaning that it is located towards the outboard direction relative to the inboard direction, without necessarily being located outside the hull of the vessel. Similarly, a position can be defined as 'inboard of' or 'more inboard than' another position, meaning that it is located towards the inboard direction relative to the outboard direction, without necessarily being located inside the hull of the vessel. In this way, 'inboard' and 'outboard' define a direction system.

The pivot axis may be located in a position which is closer to the hull compared with distance between the hull and the closest point on the drive path, when the propeller unit is in the storage configuration and when the propeller unit is in the deployment configuration. In a similar manner to that mention above, by the location of the pivot axis in this way relative to the drive path, the thruster assembly can be provided with a low profile, due to the low pivot design relative to the hull.

The housing may have a flange configured to be fixed with respect to an opening in a hull of the marine vessel. When the housing is oriented upright, the flange may be downwards-facing. When the housing is oriented upright, the pivot axis may be located in a position downwardly from the flange of the housing. By the location of the pivot axis in this way relative to the housing, the thruster assembly can be provided with a low profile, due to the low pivot design relative to the hull.

The actuator may be operable to drive a rotatable actuator shaft, rotatable about an actuator shaft rotation axis, to move the propeller unit from the storage configuration to the deployment configuration in a direction from inboard to outboard. As indicated above, the propeller unit is extended from the hull for use in the deployment configuration. The propeller unit is supported by a support assembly which is pivotable relative to the housing about the pivot axis, the pivot axis being located in a position which is outboard of the actuator shaft rotation axis.

The first, second and/or third aspects of the invention may be combined together in any combination and/or may have any one or, to the extent that they are compatible, any combination of the following optional features.

The motor may be electric (e.g. 24 V or 48 V), hydraulic, or any other type of motor suitable for driving the propeller unit. Preferably, the motor is hydraulic. The motor may be capable of delivering a mechanical power output of at least 8 kW. More preferably the motor is capable of delivering a mechanical power output of at least 9 kW, at least 10 kW, at least 11 kW, at least 12 kW, at least 13 kW, at least 14 kW, or at least 15 kW. At these relatively high powers, and particularly at the preferred power of 15 kW and higher, hydraulic motors may be more space-efficient than electric motors. As will be understood, mechanical power is determined as the product of speed and torque.

At these relatively high powers, there is a risk of breakage of the drive shaft. In particular there is a risk of breakage of the motor-side universal joint and the propeller-side universal joint. Accordingly, it is preferred for these components to be dimensioned appropriately to reduce the risk of their breakage under the power to be delivered by the motor. For a universal joint employing a yoke-type arrangement, a typical measure of the size of the universal joint is the internal axial distance from one yoke valley surface to the opposing yoke, via the hinged block between them. This is indicated in FIG. 12B. In the present case, this distance is preferably at least 40 mm, more preferably at least 45 mm. The external dimension of the universal joint may be represented by the maximum external diameter of the yoke arms. Preferably this is at least 40 mm, more preferably at least 45 mm.

In some embodiments, the housing comprises a downwards-facing flange configured to be fixed relative to an opening in the hull of the vessel. The housing is preferably fixed, via the downwards-facing flange in a sealing engagement with a corresponding upwards-facing flange formed in an insert unit suitable for bonding into the hull of the marine vessel. The sealing engagement may comprise a gasket placed between the two flanges, for example. This arrangement allows for a suitable seal, preventing ingress of water, whilst also allowing ease of installation and disassembly to permit maintenance and/or replacement of the thruster. Preferably the housing is formed from glass reinforced plastic (GRP) or poly(methyl methacrylate) (PMMA).

The housing is preferably shaped so as to at least partly conform to the shape of the components situated inside it, in order to reduce the profile of the thruster assembly inside the hull of the boat. However, the housing may take any suitable shape, preferably a shape which provides a desired low profile.

The propeller unit comprises a propeller shaft with at least one, but preferably two, propellers. Two propellers is preferred in particular for relatively high power thrusters. The propellers are preferably located at opposing ends of the propeller shaft. The drive shaft typically engages with gearing to drive the propeller shaft. The shape and size of the at least one propeller may be selected to suit the vessel, and will affect the force and direction of the lateral thrust produced by the propeller unit. The force and direction of the lateral thrust produced will also depend on the speed and direction of the rotation of the propeller shaft, as driven by the motor. Preferably the speed and direction of the rotation of the propeller shaft as driven by the motor is selectable when the thruster is operated, and may take a wide range of values. This has the advantage that different amounts of thrust can be selected as required to manoeuvre a vessel in different situations, when the thruster is installed in a marine vessel.

Preferably the propeller unit sits within a tunnel. The tunnel offers protection for the propeller unit, and allows ease of attachment of other components, for example a cover (discussed in more detail below). The tunnel may, for example, be formed from glass reinforced plastic. Preferably a cover is connected to the tunnel via a connecting means. The purpose of the cover is to cover the opening in the hull when the thruster assembly is in the storage configuration. Preferably the connecting means is a bracket, formed for example from folded metal sheet, but may be any other arrangement suitable for fixing the cover to the tunnel. Preferably the connecting means permits adjustment of the position of the cover relative to the tunnel, and therefore relative to the opening in the hull. It is not intended, however, that such adjustment would take place during operation of the thruster. In one embodiment of the invention, suitable adjustment can achieved by an arrangement of slots in the bracket, allowing repositioning of the cover.

The cover preferably has a surface finish adapted to be similar to the surface finish of the hull. This is primarily for aesthetic reasons, but it is also considered that the surface finish can affect flow of water across the cover, and it is preferable that this flow is as similar as possible to flow over the hull, to reduce drag effects when the thruster assembly is in the storage configuration.

Each universal joint may be a standard universal joint, a Cardan joint, a double Cardan joint, a constant velocity joint, or similar.

The folding nature of the drive shaft assists in the operation of the invention by permitting space-efficient storage of the thruster assembly. When the thruster assembly is moved from the storage configuration to the deployment configuration, at least part of the drive path also moves, by virtue of at least partial unfolding of the drive shaft. For efficient use of space, preferably the drive shaft folds and unfolds at the motor-side universal joint, which is at a location relatively close to the motor. This can be considered with reference to the closest point on the drive path (being defined, as above, as a point on the drive path which is closest to the pivot axis), which preferably moves along the drive path as the thruster assembly is moved from the storage configuration to the deployment configuration. Still more preferably, the movement direction of the closest point on the drive path as the thruster assembly is moved from the storage configuration to the deployment configuration is in a direction along the drive path from the motor towards the propeller unit.

It is preferable that at the start of deployment, the movement of the propeller unit is substantially perpendicular to the hull of the marine vessel, or if the hull is non-planar, substantially perpendicular to a tangent to the hull at the point where the opening is formed in the hull. This allows for more vertical downwards or outboard motion at the start of deployment, meaning that an excessive chamfer on the hull can be avoided.

The actuator may be hydraulic, electric, or pneumatic, or any other type of actuator operable to move the propeller unit from a storage to a deployment configuration. Preferably the actuator is hydraulic. The actuator may operate to move an actuator rod in a linear fashion.

The mechanism by which the actuator moves the propeller unit from a storage to a deployment configuration may be any suitable mechanism that allows the required movements of components of the thruster assembly whilst retaining a low profile format for the thruster assembly. The actuator may operate to rotate an actuator shaft, rotatable about an actuator shaft rotation axis, as set out above. The actuator shaft preferably extends through the housing via a watertight rotatable seal. The pivot axis of the support assembly is preferably offset from the actuator shaft rotation axis (i.e. is preferably not coaxial with the actuator shaft rotation axis), allowing the pivot axis to be located in a position which is outboard of the actuator shaft rotation axis. A mechanical linkage is typically provided between the actuator shaft and the support assembly. Any suitable linkage can be used, for example an arrangement of a crank, pivot and lever.

It is considered that, particular for high power thrusters, there is a risk of breakage of one or more components of the drive shaft if the propeller is driven before the propeller is in the deployment configuration. In order to address this, preferably the retractable thruster is controlled to avoid operation of the motor to drive the propeller unless the propeller is in the deployment configuration. As will be appreciated, there are different arrangements possible to provide this operation of the retractable thruster. In some embodiments, the motor is subject to the control of a mechanical-electrical switch that is operated to be ON only when the propeller is in the deployment configuration. It is preferable for such a switch to be located in a substantially dry environment. Accordingly, preferably the switch is located inboard of a seal between the housing and the hull. In some embodiments, the switch is operated by movement of a component of the mechanism by which the actuator moves the propeller unit from a storage to a deployment configuration. For example, the switch can be configured to be switched to ON when the component of the mechanism reaches a position corresponding to the propeller being in the deployment configuration. Furthermore, in such an arrangement, the switch can be configured to be switched to OFF when the component of the mechanism is located at a position other than a position corresponding to the propeller being in the deployment configuration, such as the position corresponding to the propeller being in the storage configuration or at a position intermediate the storage configuration and the deployment configuration.

Further optional features of the invention are set out below.

BRIEF DESCRIPTION OF THE DRAWINGS

Embodiments of the invention will now be described by way of example with reference to the accompanying drawings:

FIG. 12A shows a side view of the drive shaft of FIG. 11, in an extended (deployed) configuration.

FIG. 12B corresponds to FIG. 12A but with some exemplary dimensions indicated.

FIG. 13 shows a side view of the drive shaft of FIG. 11, in a contracted (storage) configuration.

Figure 1:
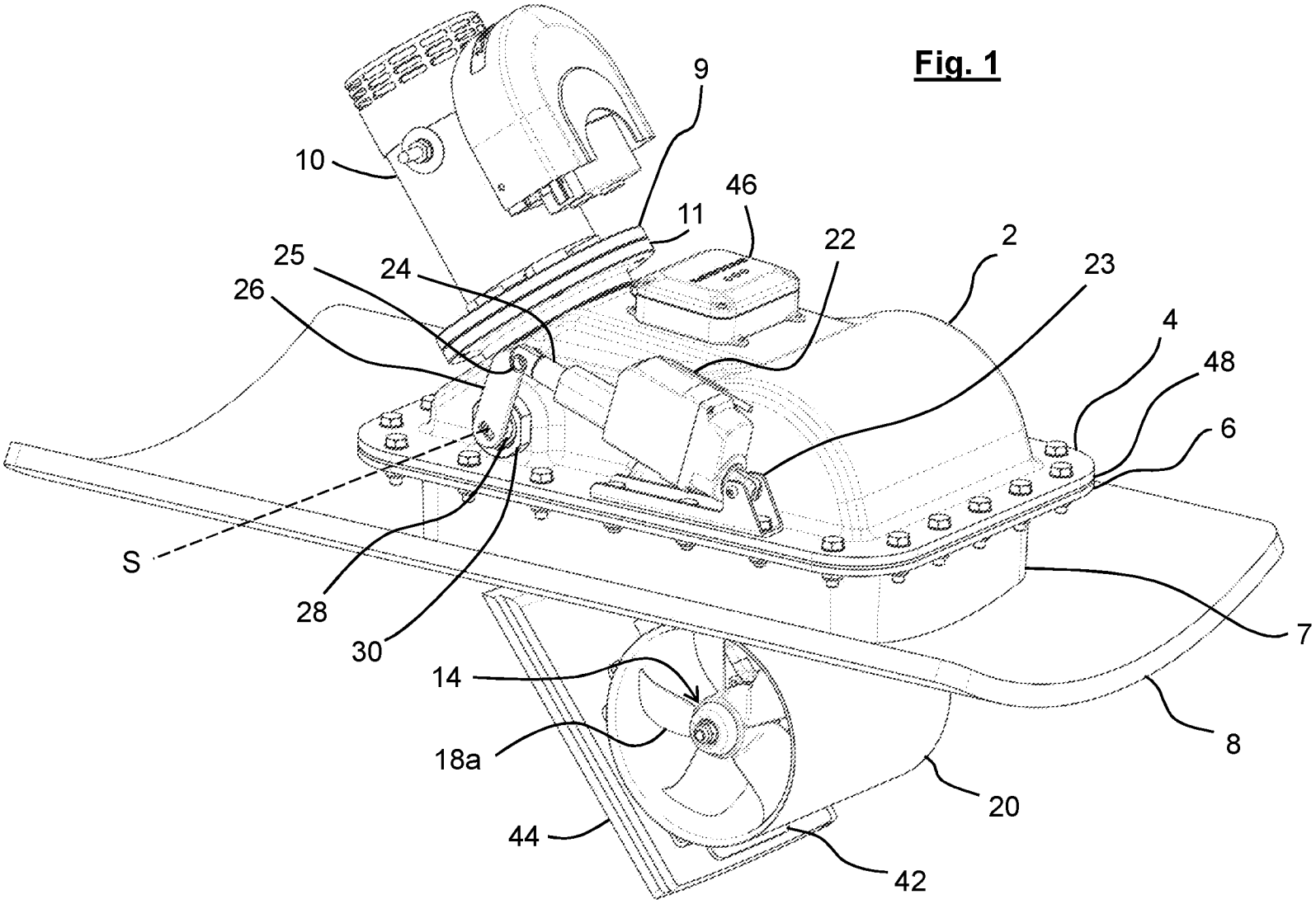
FIG. 1 shows an isometric view of a retractable thruster assembly according to EP-A-3168137, including part of the hull of a vessel to which the retractable thruster is fixed, with the support assembly and propeller unit in a deployed configuration.
Figure 2:
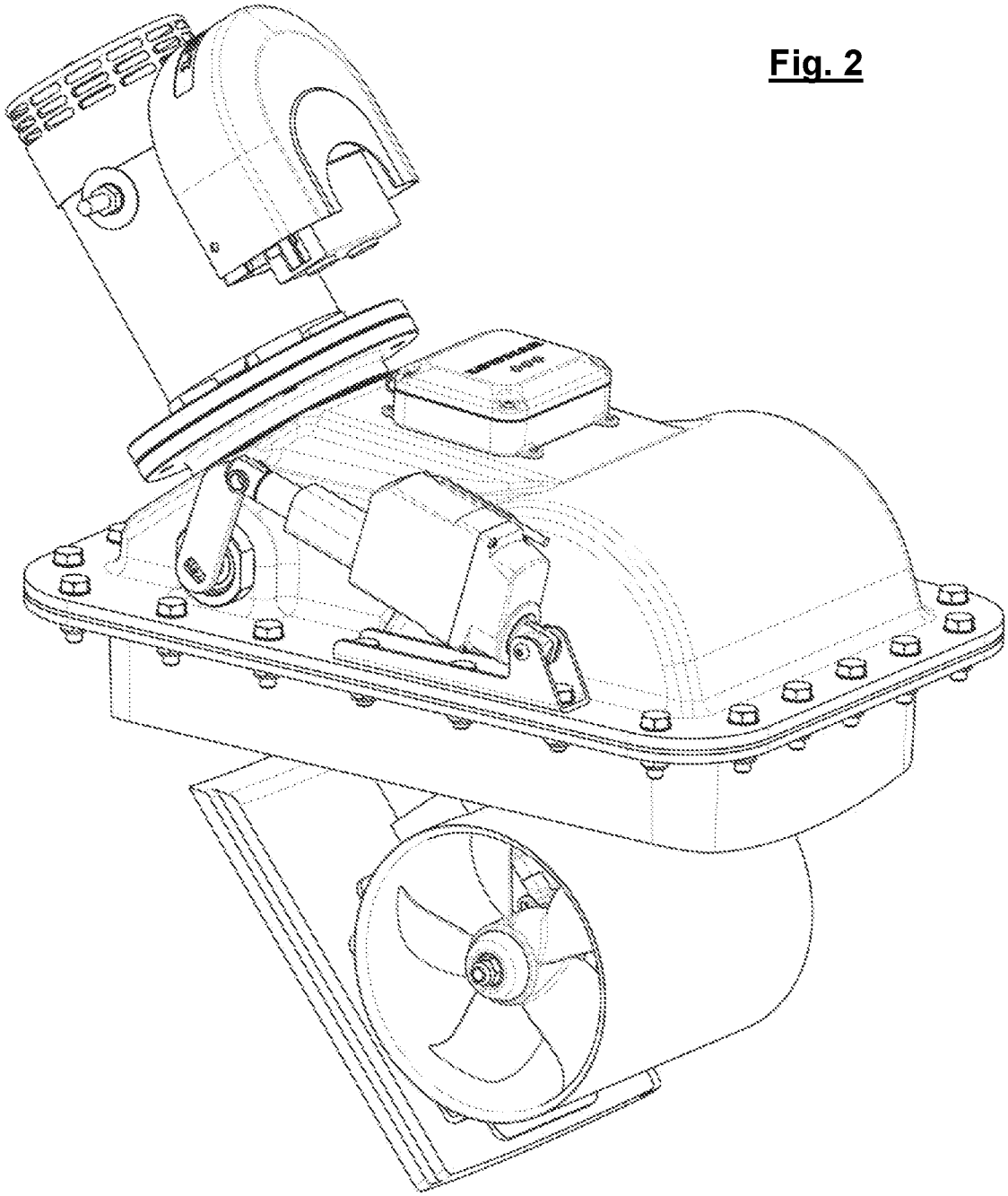
FIG. 2 shows an isometric view of the retractable thruster assembly of FIG. 1, with the support assembly and propeller unit in a deployed configuration.
Figure 3:
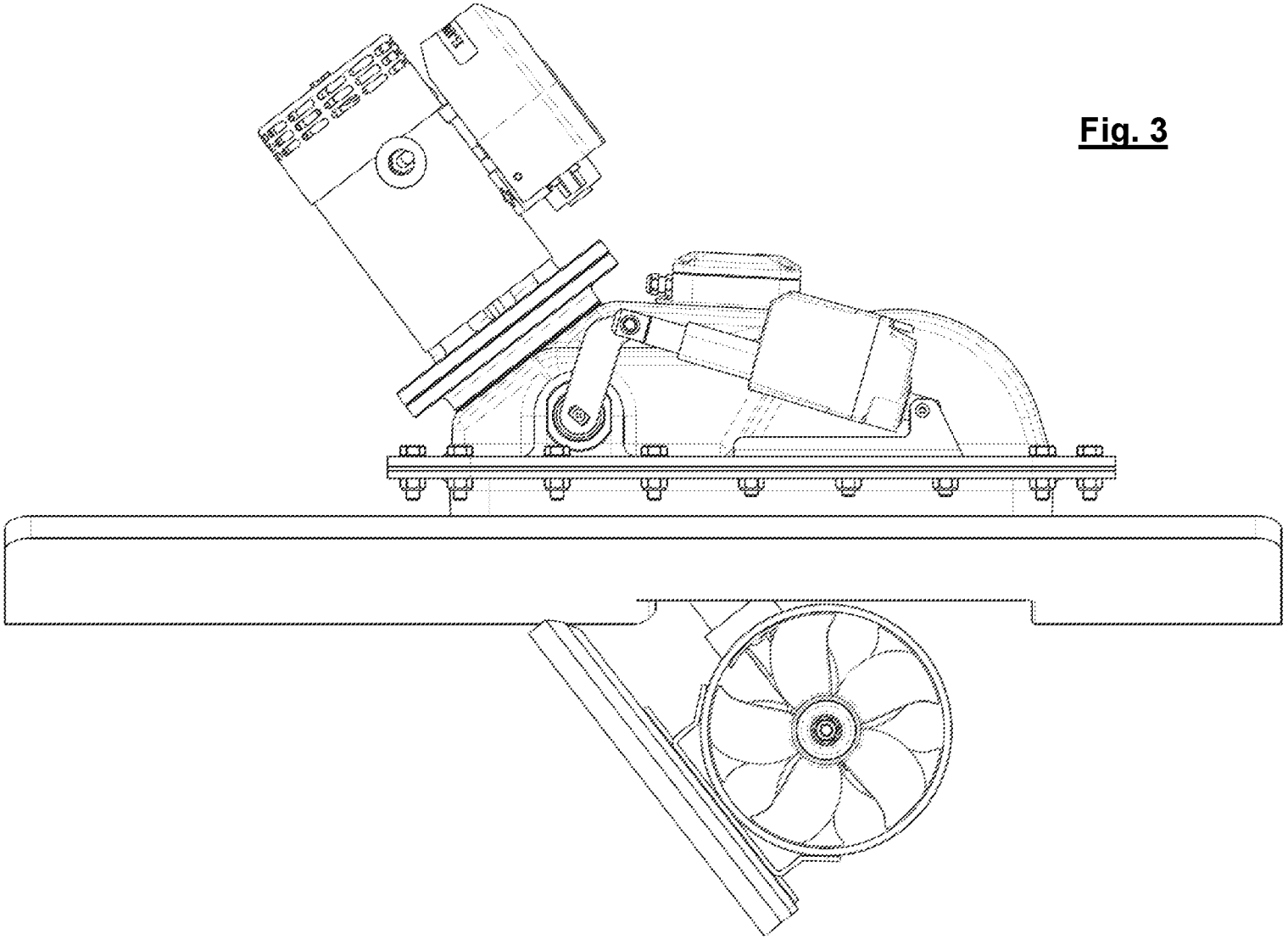
FIG. 3 shows a side view of the assembly of FIG. 1.

DETAILED DESCRIPTION OF THE PREFERRED EMBODIMENTS, AND FURTHER OPTIONAL FEATURES OF THE INVENTION

FIGS. 1-10 are reproduced from EP-A-3168137. They illustrate a reference arrangement that assists in the understanding of the preferred embodiment of the present invention, described later with reference to FIGS. 11-22.

FIGS. 1-10 use the same reference numbers for the same features, and some features are identified with reference numbers in only some of the drawings. Similarly, FIGS. 11-22 use the same reference numbers for the same features, and some features are identified with reference numbers in only some of the drawings.

According to the reference arrangement as shown in FIG. 1-10, with particular reference to FIGS. 1, 4, 6, and 8, the retractable thruster has a housing 2 with a downwardly-facing bottom flange 4 intended to be fixed in a sealing engagement with a corresponding upwardly-facing flange 6 of an insert unit 7 located at an opening formed in a hull 8 of a marine vessel. Together, the hull 8, insert unit 7 and housing 2 provide a watertight seal against ingress of water.

Motor 10 is fixed with respect to the housing 2. Motor 10 has a rotor (not shown) with an axis of rotation at an angle of about 45° relative to a plane defined by downwardly-facing bottom flange 4. In turn, downwardly-facing bottom flange 4 is located substantially parallel to the hull 8 of the vessel. Where the hull is not planar, downwardly-facing bottom flange 4 is located substantially parallel to a tangent T to hull 8 of the vessel where the opening is formed. The disposition of the motor at an angle allows the motor to take up less space in the hull. The angle is preferably at least about 30°. Using an angle of less than about 30° would require that the drive shaft remains substantially folded when the propeller unit is in the deployed configuration. This reduces the efficiency of operation of the thruster assembly. The angle is preferably at most about 60°, in order to ensure that the space-saving advantages are achieved.

Ensuring that the motor is fixed with respect to the housing allows the position of the motor to remain stationary with respect to the housing and hull during operation. This reduces health and safety risks that would be associated with movement of the motor. Additionally, the space-saving advantages of the position and orientation of the motor are ensured. Furthermore, the associated wiring of the motor is not subjected to unnecessary movement, risking additional wear and tear. Still further, fixing of the motor relative to the housing allows a straightforward watertight seal to be interposed between the motor and the housing. A suitable seal can be a flange seal for example, between motor flange 9 and housing flange 11.

Drive shaft 12 connects motor 10 to propeller unit 14. Drive shaft 12 is a telescopic universal joint drive shaft. In this reference arrangement, only two telescoping sections are used in the drive shaft.

Propeller unit 14 comprises a propeller shaft 16 with one propeller 18 fixed at each end, the drive shaft 12 engaging with gearing to drive the propeller shaft 16 at a location intermediate the propellers. The propeller unit 14 is housed in a tunnel 20.

Actuator 22 (which is hydraulic in this reference arrangement but may optionally be electric or pneumatic) is pivotably attached with respect to the housing 2 at actuator pivot 23, the actuator 22 being operable to extend and retract actuator rod 24. The position of the actuator also has a low profile in comparison with known thruster assemblies. Although the actuator can pivot during use (as explained below), preferably the actuator rod 24 of the actuator 22 subtends a maximum angle of up to about 30° with respect to the flange 4 of the housing 2. This has the advantage of saving space in the vessel.

Actuator rod 24 is pivotably attached at pivot 25 to crank 26. The crank is fixed to a rotatable shaft 28 at one end of the shaft. The shaft extends through the housing 2 via a rotatable seal 30. At its other end, the rotatable shaft is fixed to an intermediate crank 32, which in turn is pivotably attached at pivot 33 to rod 34. Rod 34 is pivotably attached at pivot 35 to a support assembly 36. The support assembly 36 comprises a pair of cooperating arms 36*a*, 36*b* which are disposed in parallel relation to each other, on either side of the drive shaft 12.

Rod 34 attaches to arm 36*a* at lever extension 38. Arm 36*a* is arranged to rotate around pivot 40, defining pivot axis A, on operation of the actuator 22. The support assembly 36 attaches to the tunnel 20 via a suitable connection at the ends of the arms 36*a*, 36*b*. In this way, arms 36*a*, 36*b* are constrained to move with each other.

Pivot 40 is formed between the arms 36*a*, 36*b* and respective arms 41*a*, 41*b* of bracket 41. Bracket 41 is fixed with respect to the housing 2. A space is defined between arms 41*a*, 41*b* of bracket 41 to accommodate the drive shaft 12.

Figure 4:
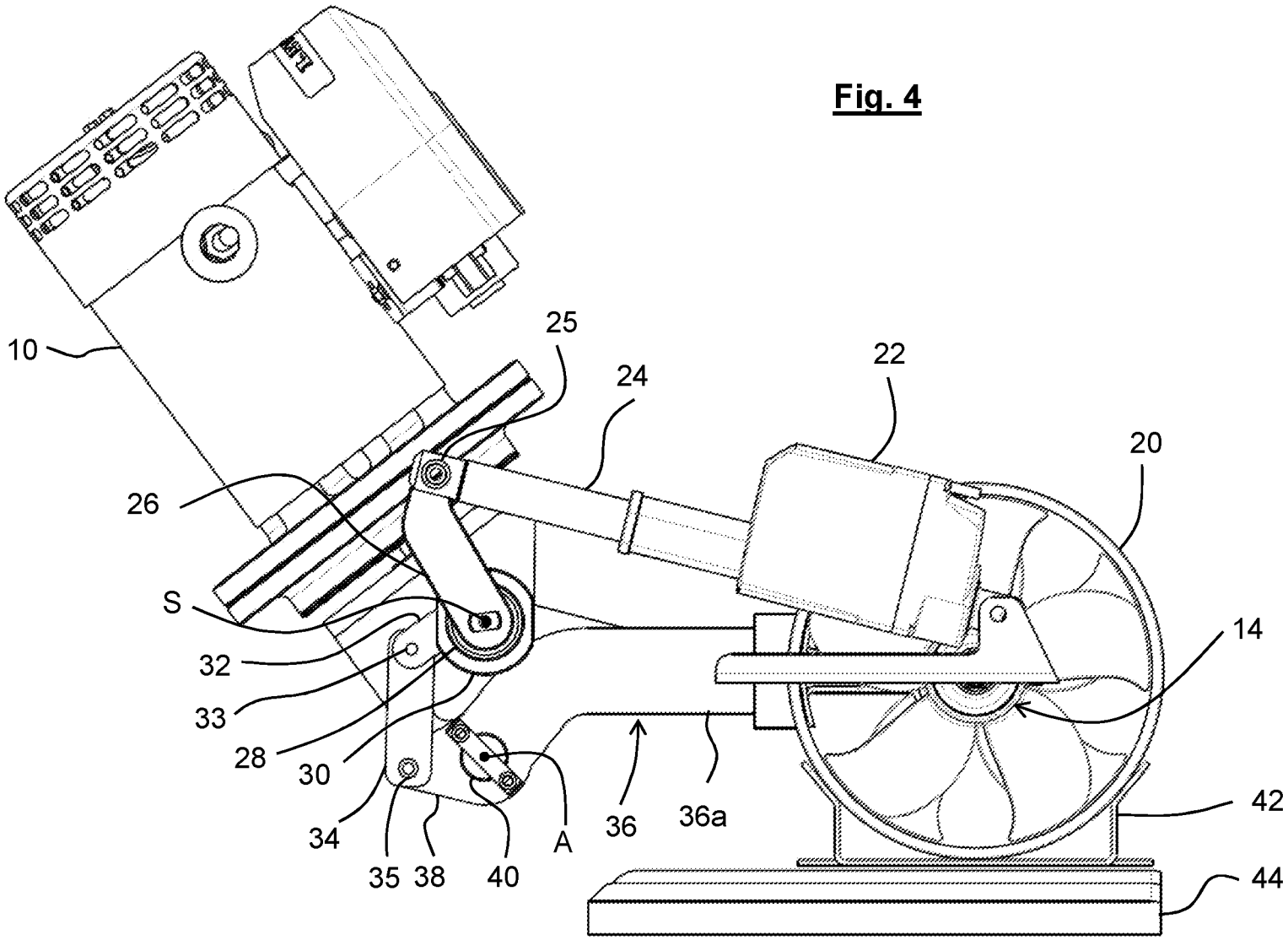
FIG. 4 shows a side view of the retractable thruster assembly of FIG. 1, with the housing, hull, and hull-bonded insert unit not shown, with the support assembly and propeller unit in a storage configuration.
Figure 5:
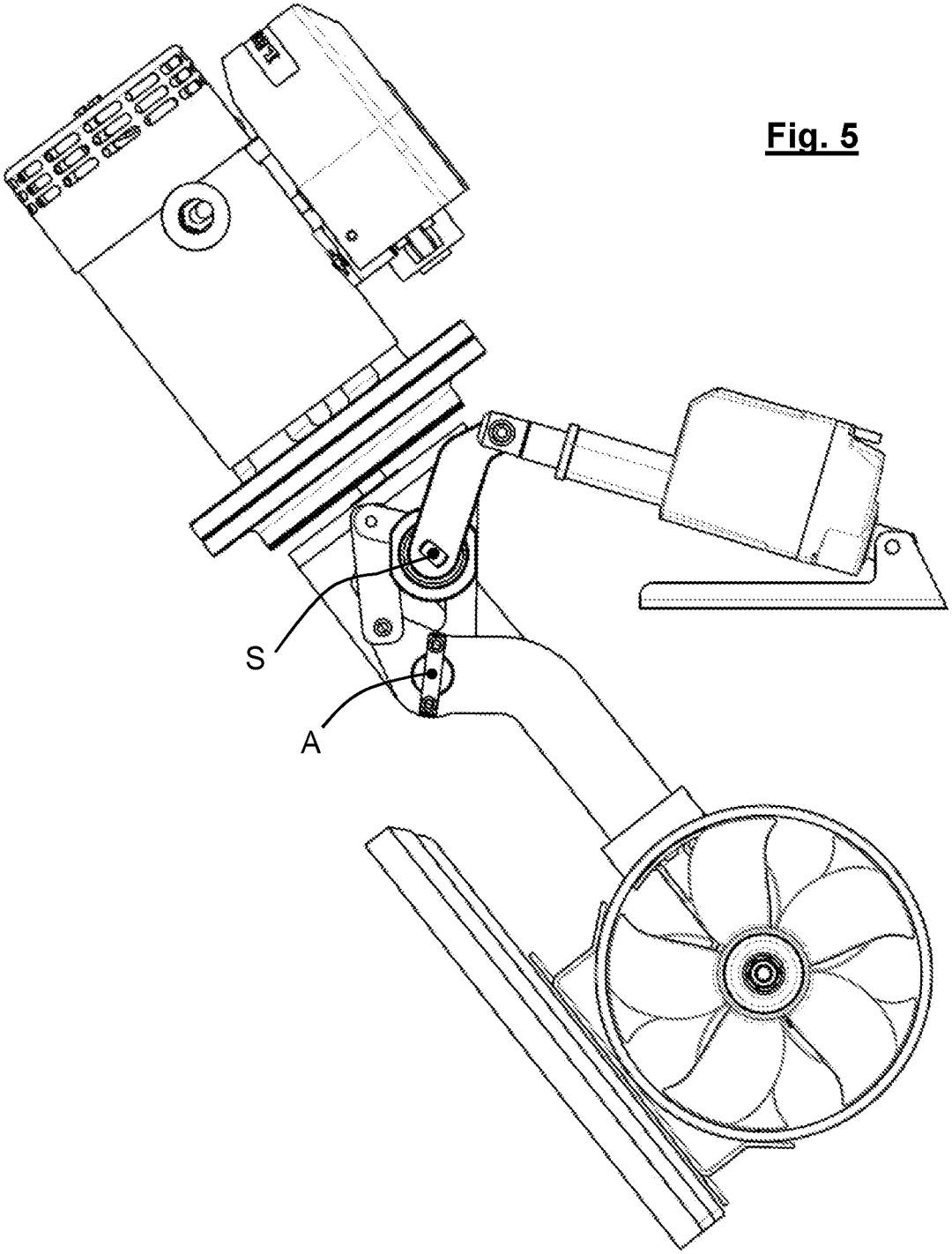
FIG. 5 shows a side view of the retractable thruster assembly of FIG. 1, with the housing, hull, and hull-bonded insert unit not shown, with the support assembly and propeller unit in a deployed configuration.

Operation of the actuator therefore moves the tunnel 20 and the associated propellers 18 between the storage configuration (shown in FIG. 4) and the deployment configuration (shown in FIG. 5).

Folded bracket 42 is fixed to the tunnel 20. This is intended to have a cover 44 attached to it, in order to conform to the outer shape of the hull 8 when the thruster is in the storage configuration. Cover 44 has a surface finish (not shown) adapted to be similar to the surface finish (not shown) of the hull.

Electronic control box 46 is mounted to the housing 2, for housing control components (not shown) for the motor 10 and/or actuator 22.

Further details of the construction and operation of the thruster assembly according to the reference arrangement will now be set out.

The flange-mounted arrangement for the thruster assembly reduces build time, and allows for easier installation and replacement of the retractable thruster. The material for the housing 2 is preferably GRP or PMMA. The housing 2 is preferably shaped so as to at least partially conform to the shape of the support assembly 36 and/or the tunnel 20. In this way, the profile of the thruster assembly within the hull is reduced. The sealing engagement is preferably achieved by arrangement of a gasket 48 between the corresponding flanges 4, 6.

The motor 10 is arranged for driving propeller unit, generally denoted with reference number 14, via a drive shaft 12. Propeller unit 14 comprises a propeller shaft 16 with propellers 18*a*, 18*b* disposed at opposite ends of the propeller shaft 16. Drive shaft 12 engages with gearing to drive the propeller shaft 16, in a known manner. The shape and size of the propellers 18*a*, 18*b* may be varied, and will affect the force and direction of the lateral thrust produced by the propeller unit for a particular rotational speed and rotational direction (as determined by operation of the motor 10).

The deployment of the support assembly 36 is best described with reference to FIGS. 4 and 5. Starting from the storage configuration illustrated in FIG. 4, actuator 22 is operated to retract actuator rod 24. This retraction of the actuator rod gives rise to clockwise rotation of the crank 26, which is transmitted via the rotatable shaft 28 passing through the rotatable seal 30 to the intermediate crank 32. Intermediate crank 32 therefore also rotates clockwise. Clockwise rotation of intermediate crank 32 pulls rod 34 upwardly. The upward motion of rod 34 rotates lever 38 clockwise about pivot axis A, thereby causing the support assembly 36 and propeller unit 14 also to rotate clockwise about pivot axis A, until the deployment configuration is reached as shown in FIG. 5.

Figure 6:
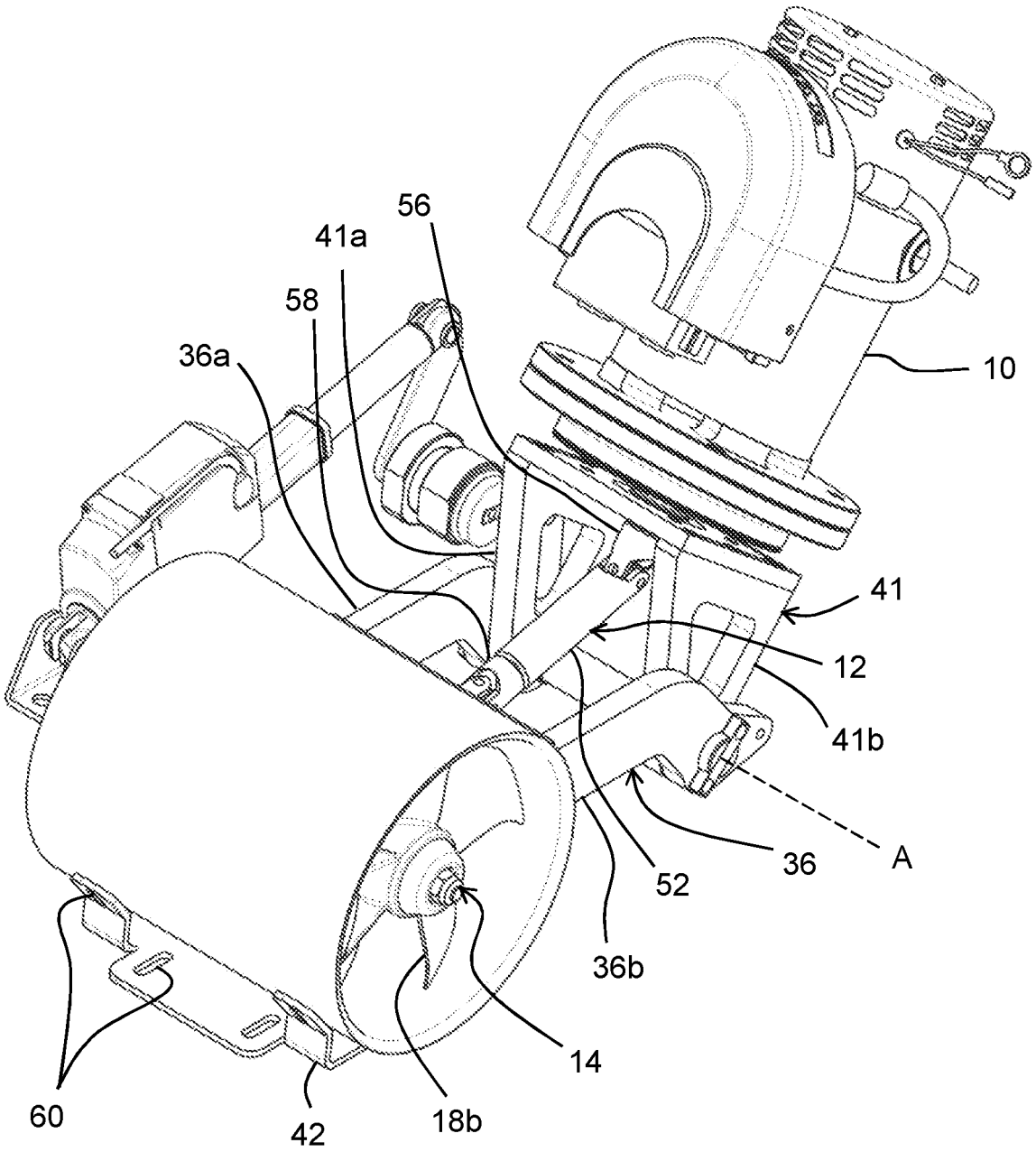
FIG. 6 shows an isometric view of the retractable thruster assembly of FIG. 4.
Figure 7:
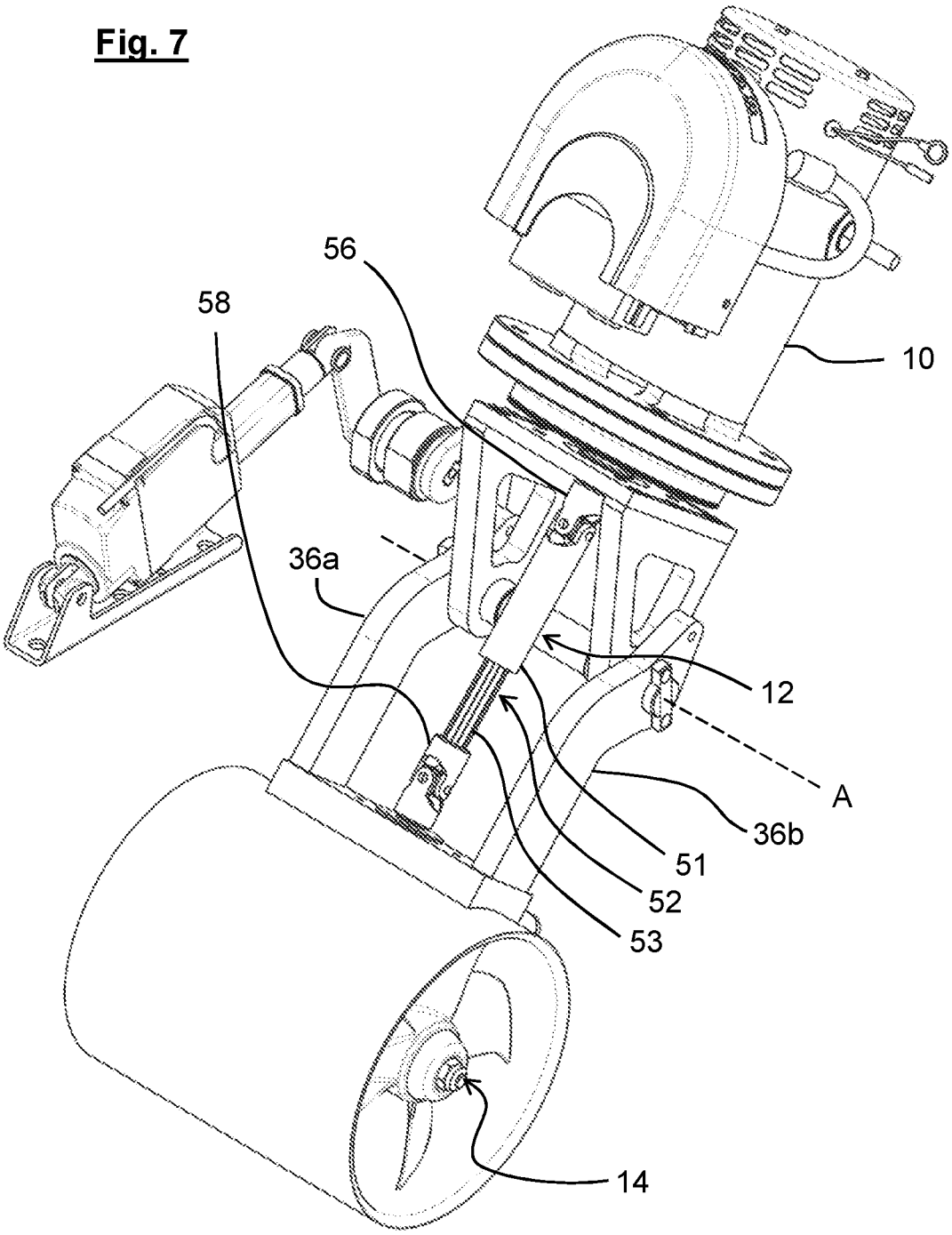
FIG. 7 shows an isometric view of the retractable thruster assembly of FIG. 5.
Figure 8:
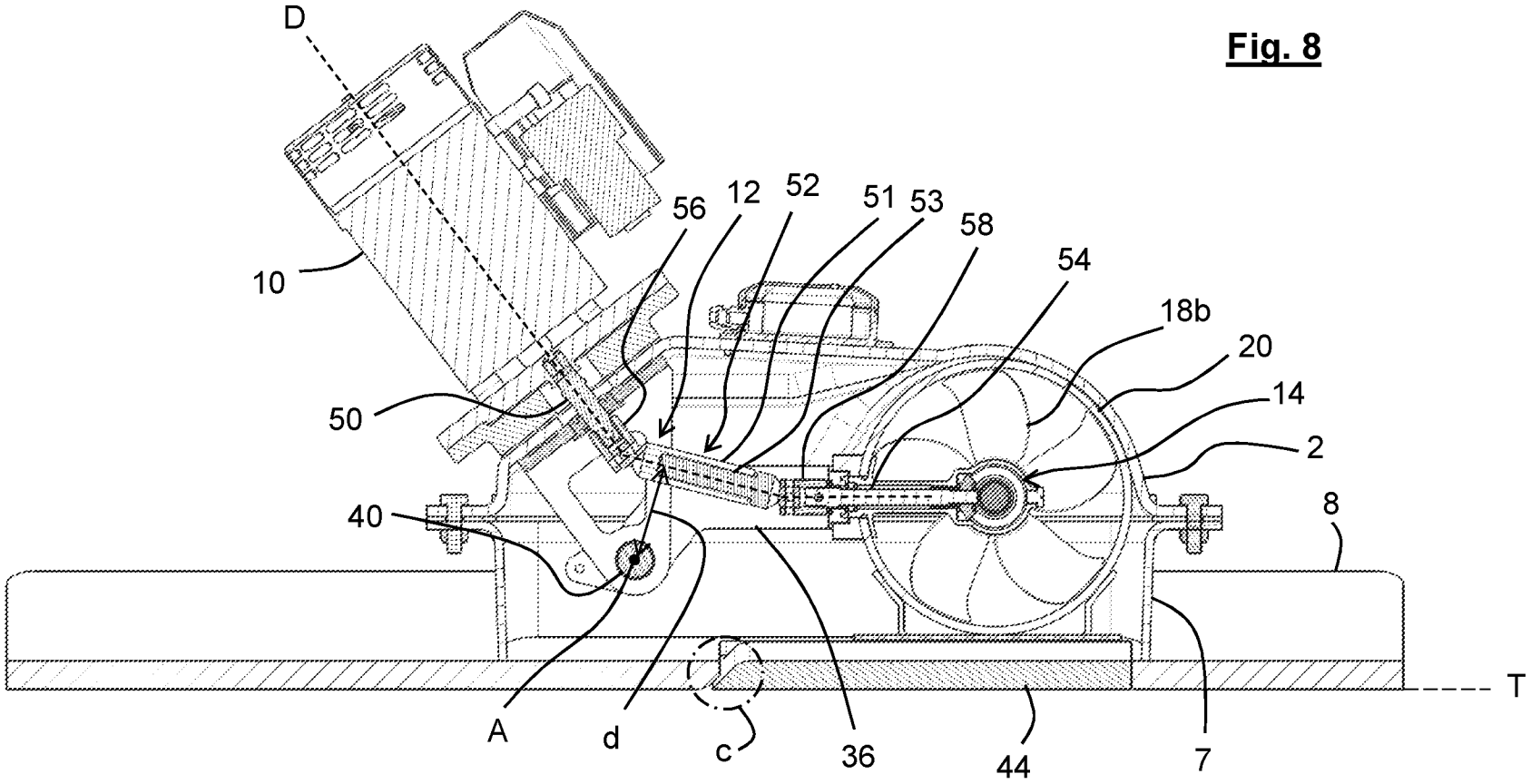
FIG. 8 shows a cross-sectional view of the retractable thruster assembly of FIG. 1, with the support assembly and propeller unit in a storage configuration.

The drive shaft 12 of the reference arrangement, as best seen in FIG. 7 and shown in cross section in FIG. 8, is a telescopic universal joint drive shaft, comprising a driving shaft 50 connected to the motor 10, a telescopically extendable intermediate shaft assembly 52, a driven shaft 54 connected to the propeller unit 14, and two universal joints 56, 58, arranged respectively between the driving shaft 50 and the intermediate shaft assembly 52, and the intermediate shaft assembly 52 and the driven shaft 54. The telescopically extendable intermediate shaft assembly 52 comprises a splined sleeve 51 cooperating with a splined shaft 53. This setup allows for transmission of torque from motor to propeller, whilst allowing changes in length of the drive shaft 12, and also allows folding of the drive shaft at the universal joints 56, 58, to accommodate the storage configuration. The change in length of the drive shaft during movement between storage and deployment configurations can be seen by comparing FIG. 6 to FIG. 7. During this movement, the splined shaft 53 extends from the splined sleeve 51, allowing the drive shaft 12 to lengthen. When in the deployment configuration, the drive shaft 12 is substantially rectilinear, allowing for efficient power transmission from motor 10 to propeller unit 14.

Figure 9:
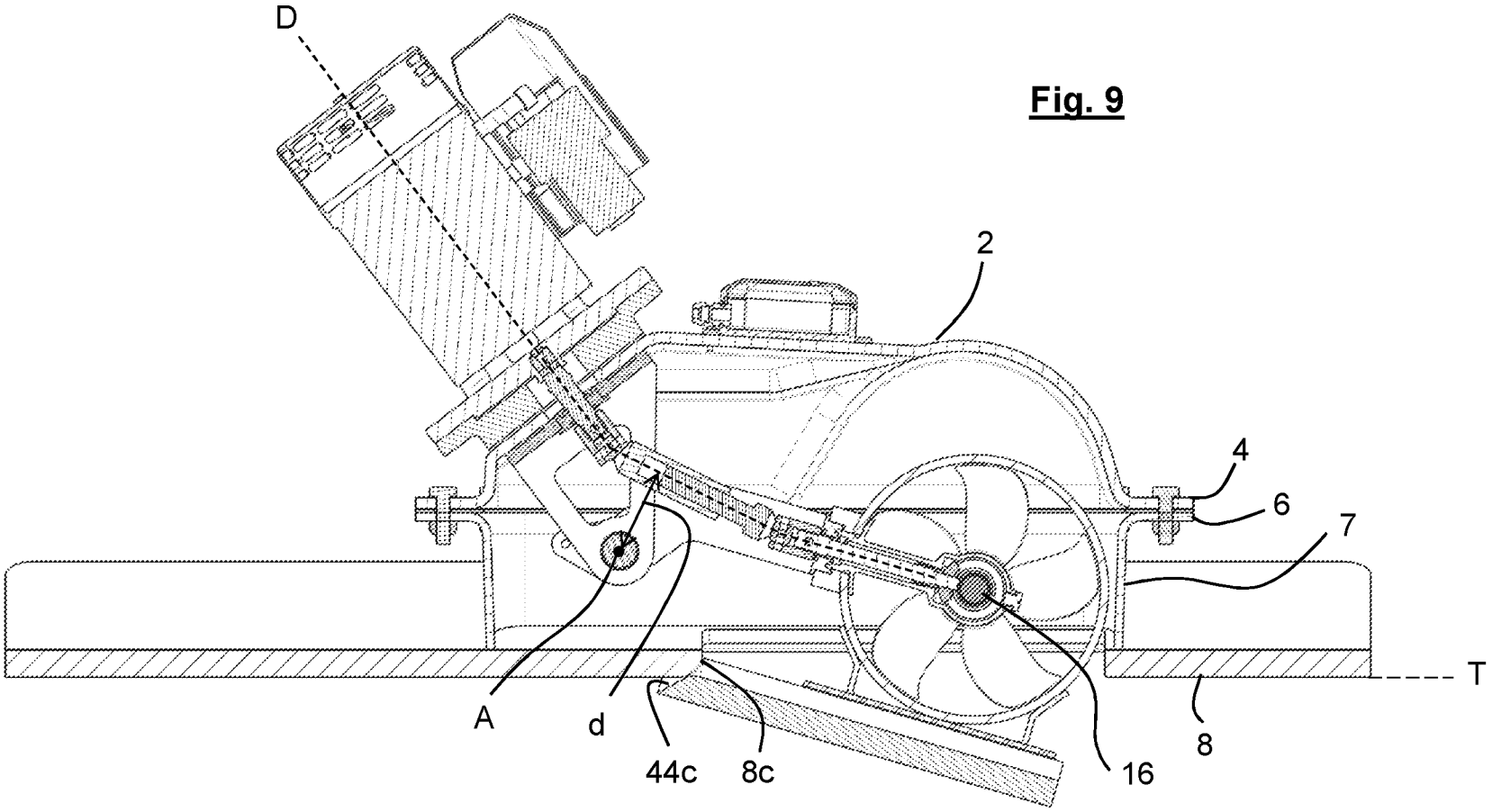
FIG. 9 shows a cross-sectional view of the retractable thruster assembly of FIG. 1, with the support assembly and propeller unit in a partially-deployed configuration.
Figure 10:
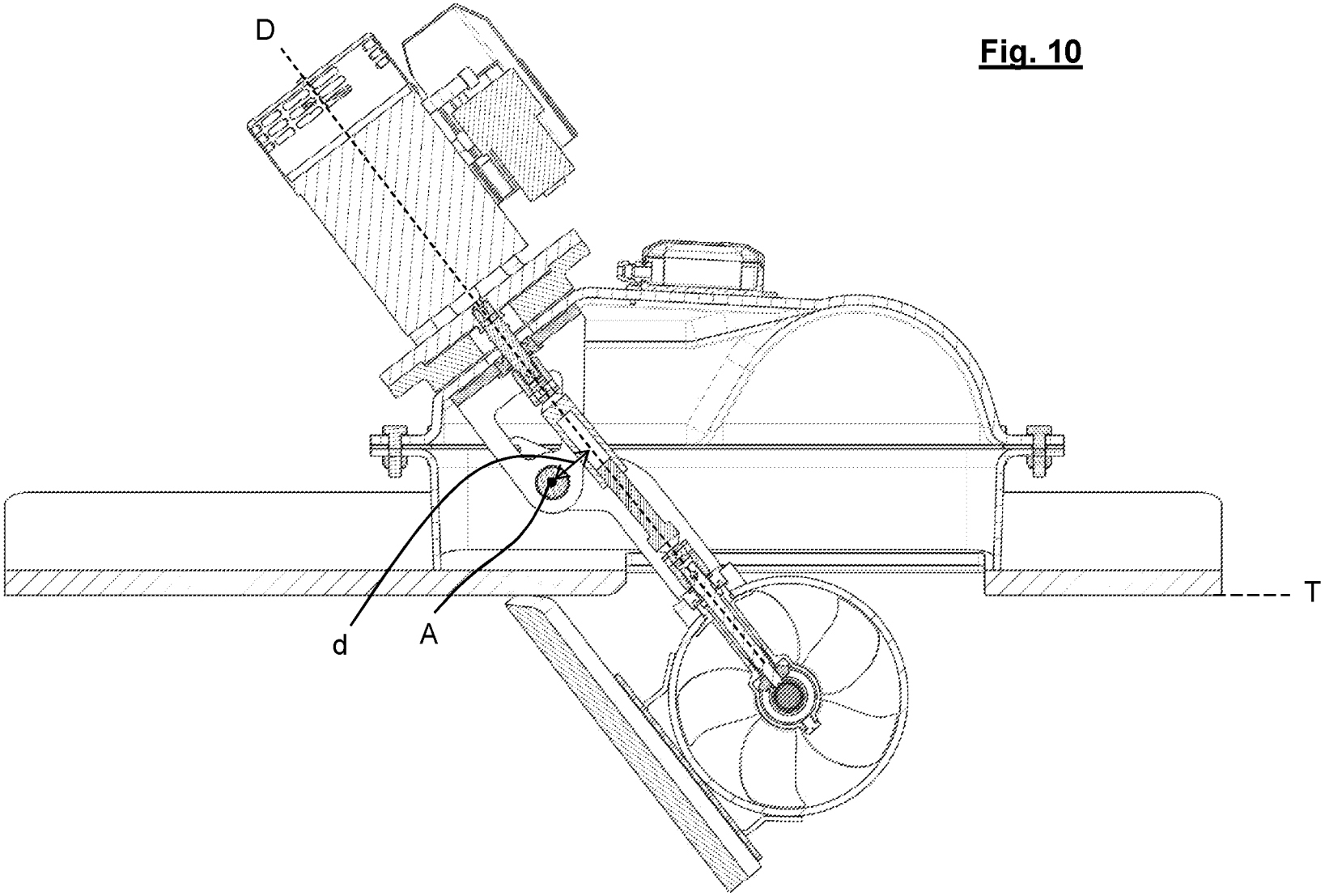
FIG. 10 shows a cross-sectional view of the retractable thruster assembly of FIG. 1, with the support assembly and propeller unit in a deployed configuration.

The drive path D is indicated by a dashed line in FIGS. 8-10.

The pivot axis A for the support assembly sits at a location which is low relative to the remainder of the thruster assembly, and close to the hull of the vessel. Preferably, pivot axis A is located within the depth of the insert unit 7 bonded to the hull of the vessel, as seen in FIG. 8-10. The effect of having this low pivot axis on the path of travel of the support assembly is that the cover 44 and tunnel 20 can move almost perpendicularly to the hull from the retracted configuration, at the start of deployment. This means that only a small amount of chamfer is needed, as shown in region C indicated in FIG. 8, for the cover 44 and the hull 8, to accommodate the movement of the cover relative to the hull whilst still allowing the cover 44 to make a snug fit in the opening in the hull in the storage configuration. A snug fit is preferred in order to reduce drag during normal use of the vessel. The close approach of chamfer portions 8*c* of the hull 8 and 44*c* of the cover 44 is shown in FIG. 9.

As the drive shaft 12 moves with the propeller unit 14, the closest point on the drive path D to the pivot axis A changes position on the drive path D. The distance between the pivot axis A and the closest point is indicated by distance d in FIGS. 8-10. As can be seen, the closest point on the drive path D to the pivot axis A remains inboard of pivot axis A, whether the propeller unit is in the storage or deployment configurations.

The folded bracket 42 attached to the tunnel 20 has an arrangement of slots 60, as seen in FIG. 6, to allow adjustment of the position of the cover 44 relative to the tunnel 20. It is not intended that this adjustment takes place during operation of the retractable thruster.

Electronic control box 46 disposed on the housing 2 of the retractable thruster controls operation of the retractable thruster. The electronic control box is connectable to an input device, for example as part of a control panel (not shown) of the vessel. This input device, which preferably comprises either a joystick panel or touch-button panel, can be used to operate the retractable thruster by a person manoeuvring the vessel to which the retractable thruster is fitted.

The preferred embodiments of the present invention will now be described with reference to FIGS. 11-22. It is intended that features of the drive shaft and/or the control of the operation of the motor described and illustrated here are to be substituted for the corresponding components in the reference arrangement described above in order to arrive at embodiments of the present invention.

Figure 11:
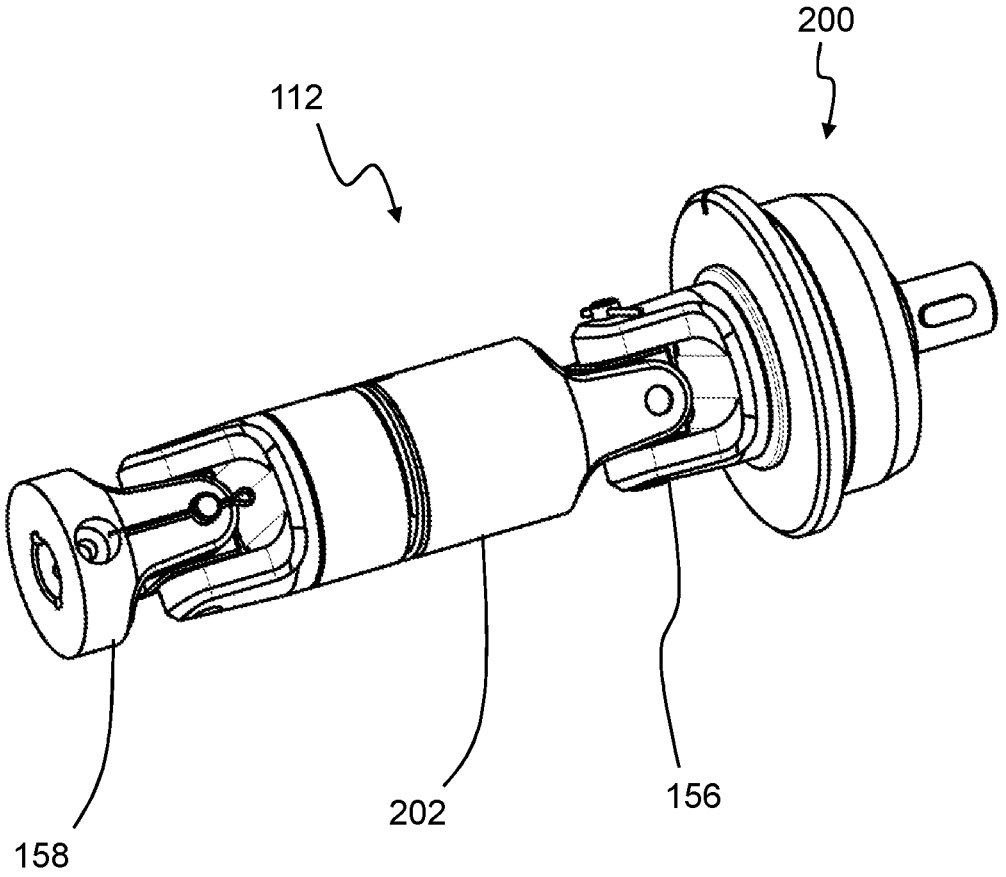
FIG. 11 shows a perspective view of a drive shaft for use with an embodiment of the present invention.

FIG. 11 shows a perspective view of a drive shaft 112 for use with an embodiment of the present invention. The drive shaft has a motor-side universal joint 156 for attachment to the motor via seal arrangement 200 and a propeller-side universal joint 158 for attachment to the propeller unit.

As will be understood based on FIGS. 1-10, the motor-side universal joint and the propeller-side universal joint permit folding of the drive shaft in the storage configuration. The drive shaft also has a motor-side telescopic section 202 disposed adjacent the motor-side universal joint 156. Not visible in FIG. 11, the drive shaft also has a propeller-side telescopic section 206 disposed adjacent the propeller-side universal joint and an intermediate telescopic section 204 disposed between the motor-side telescopic section 202 and the propeller-side telescopic section 206.

The motor-side telescopic section 202, the intermediate telescopic section 204 and the propeller-side telescopic section 206 are coaxial and slidable relative to each other to accommodate an increase in distance between the propeller unit and the motor when the propeller unit is moved from the storage configuration to the deployment configuration.

FIGS. 12A and 12B show side views of the drive shaft of FIG. 11, in an extended (deployed) configuration. FIG. 13 shows a side view of the drive shaft of FIG. 11, in a contracted (storage) configuration.

Figure 14:
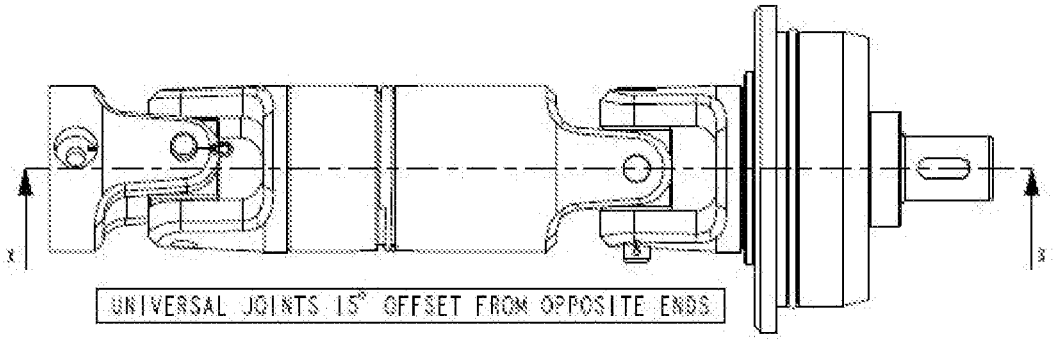
FIG. 14 shows an alternative side view of the drive shaft of FIG. 11, in a contracted (storage) configuration.

FIG. 14 shows an alternative side view of the drive shaft of FIG. 11, in a contracted (storage) configuration. It is apparent on consideration of FIGS. 14 and 12A and 12B that the universal joints are not angularly offset from each other by 90°, as might otherwise be expected. Instead, they are offset from each other by an acute angle of 75°. The purpose of this is to avoid a rotational position of the drive shaft in which each of the universal joints is at 45° to the direction of movement of the drive shaft from the storage to the deployment configurations. This can lead to unwanted stresses on the universal joints and breakage.

Figure 15:
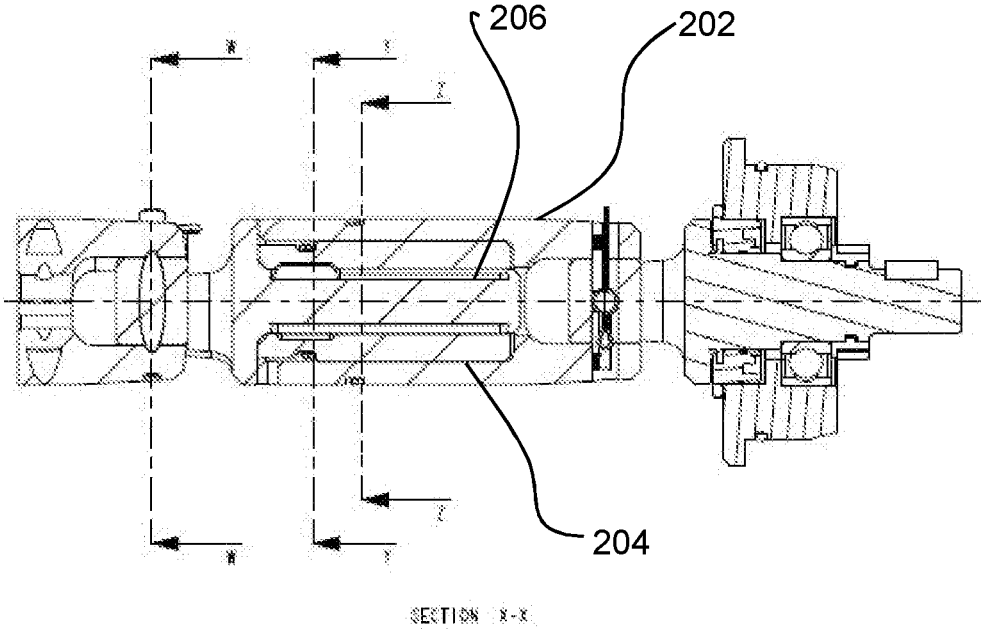
FIG. 15 shows a cross sectional view along the principal axis of the drive shaft, taken along line X-X in FIG. 14.

FIG. 15 shows a cross sectional view along the principal axis of the drive shaft, taken along line X-X in FIG. 14.

Figure 19:
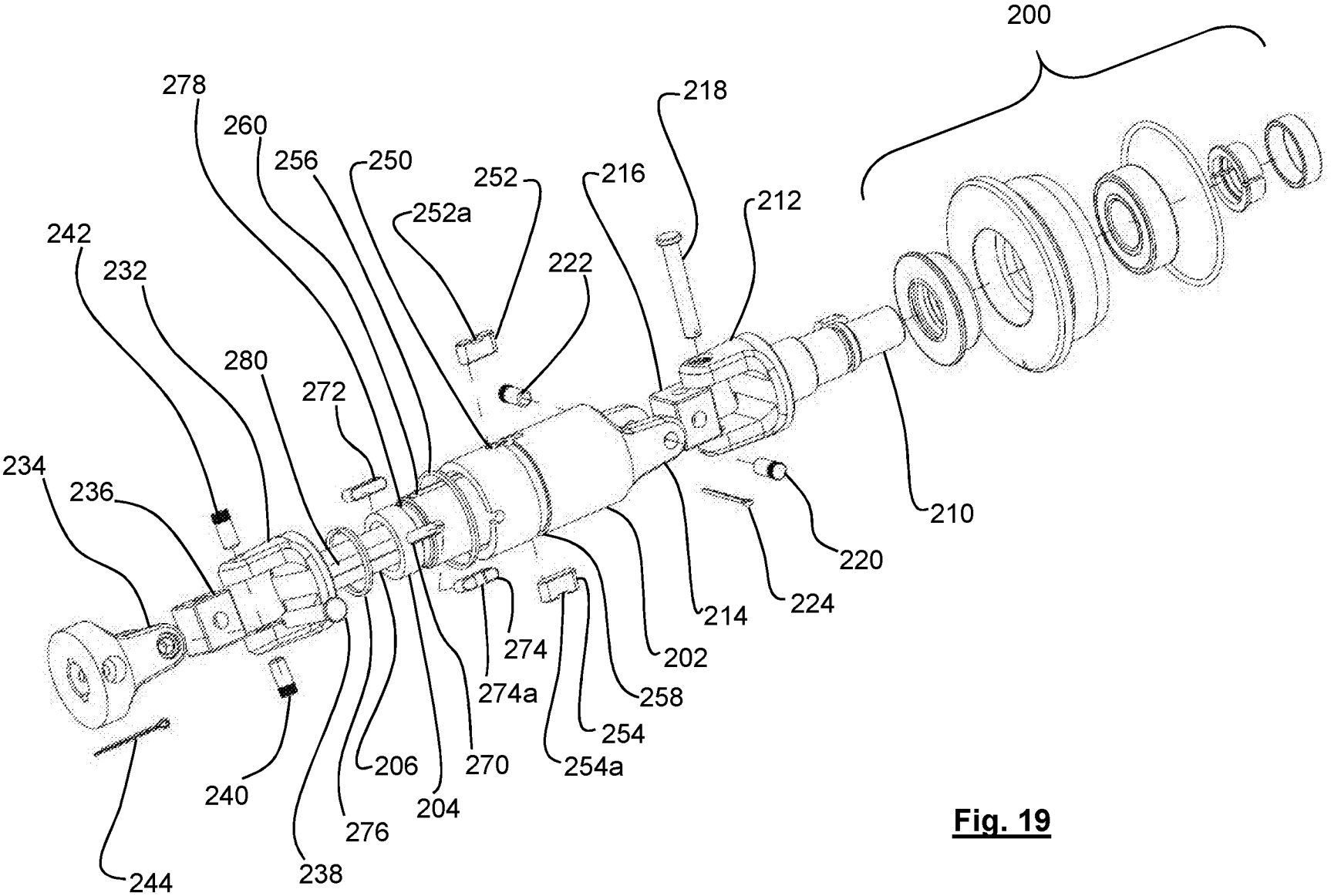
FIG. 19 shows an exploded perspective view of the drive shaft of FIG. 11.

Turning now to the exploded view shown in FIG. 19, here the components of the motor seal 200 are shown—they are not described in further detail here. Motor shaft 210 extends through motor seal 200 and terminates at an end distal from the motor at a first yoke 212 of the motor-side universal joint 156. In a known manner, first yoke 212 is connected to a second yoke 214 offset at 90° via a hinge block 216 and an arrangement of a long pin 218 and cotter pin 224, and short pins 220, 222 cooperating with respective holes formed in the hinge block 216.

A corresponding arrangement is found at the propeller-side universal joint 158. The propeller-side telescopic section 206 terminates at an end distal from the motor at a first yoke 232 of the propeller-side universal joint 158. In a known manner, first yoke 232 is connected to a second yoke 234 offset at 90° via a hinge block 236 and an arrangement of a long pin 238 and cotter pin 244, and short pins 240, 242 cooperating with respective holes formed in the hinge block 236.

The motor-side telescopic section 202 is provided with the second yoke 214. Motor-side telescopic section 202 takes the form of an outer sleeve for the drive shaft. Keyway apertures 250 are formed on opposing sides of the motor-side telescopic section 202 to receive keys 252, 254. These are retained in position in the motor-side telescopic section 202 by retaining ring 256 which itself fits in annular groove 258 formed in the outer surface of the motor-side telescopic section 202. Retaining ring 256 also cooperates with grooves 252*a* and 254*a* formed in the keys 252 and 254. When assembled, the keys project from an internal surface of the motor-side telescopic section 202.

Intermediate telescopic section 204 fits slidably inside motor-side telescopic section 202. The outer surface of the intermediate telescopic section 204 is provided with longitudinal slots 260 to receive keys 252 and 254. Accordingly, intermediate telescopic section 204 is constrained to rotate with motor-side telescopic section 202 by engagement of keys 252 and 254 in apertures 250 of the motor-side telescopic section 202 and in slots 260 of the intermediate telescopic section 204. The length of the slots 260 of the intermediate telescopic section 204 determine the range of axial slidable movement of the slots 260 of the intermediate telescopic section 204 relative to the motor-side telescopic section 202.

In a similar manner to the cooperation of the intermediate telescopic section 204 with the motor-side telescopic section 202, propeller-side telescopic section 206 fits slidably inside intermediate telescopic section 204.

Intermediate telescopic section 204 takes the form of a sleeve for the drive shaft. Keyway apertures 270 are formed on opposing sides of the intermediate telescopic section 204 to receive keys 272, 274. These are retained in position in the intermediate telescopic section 204 by retaining ring 276 which itself fits in annular groove 278 formed in the outer surface of the intermediate telescopic section 204. Retaining ring 276 also cooperates with grooves 274*a* formed in the keys 272 and 274. When assembled, the keys project from an internal surface of the intermediate telescopic section 204.

Propeller-side telescopic section 206 fits slidably inside intermediate telescopic section 204. The outer surface of the propeller-side telescopic section 206 is provided with longitudinal slots 280 to receive keys 272 and 274. Accordingly, propeller-side telescopic section 206 is constrained to rotate with intermediate telescopic section 204 by engagement of keys 272 and 274 in apertures 270 of the intermediate telescopic section 204 and in slots 280 of the propeller-side telescopic section 206. The length of the slots 280 of the propeller-side telescopic section 206 determine the range of axial slidable movement of the slots 280 of the propeller-side telescopic section 206 relative to the intermediate telescopic section 204.

Accordingly, for a given available space in the storage configuration, the distance between the motor and the propeller unit is known. Where the motor is configured to deliver substantial power, it is necessary for the motor-side universal joint and the propeller-side universal joint to be strong and therefore relatively large in order to avoid failure during service. The remaining available space for the telescopic drive shaft is therefore limited, without disadvantageously enlarging the format of the retractable thruster assembly. Accordingly, the added complexity of the three part telescopic drive shaft is justified in order to provide the required extension of the drive shaft in order for the propeller unit to be fully deployed from the hull.

Figure 16:
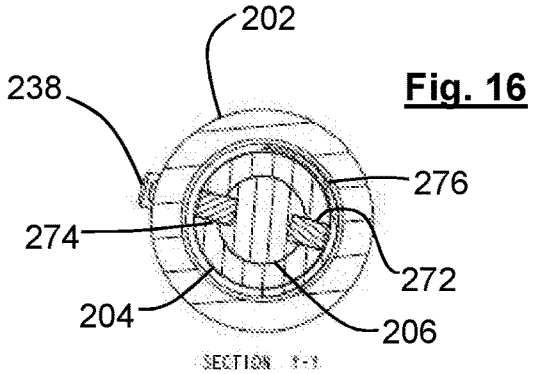
FIG. 16 shows a cross sectional view of the drive shaft, taken perpendicular to the principal axis of the drive shaft, along line Y-Y in FIG. 15.
Figure 17:
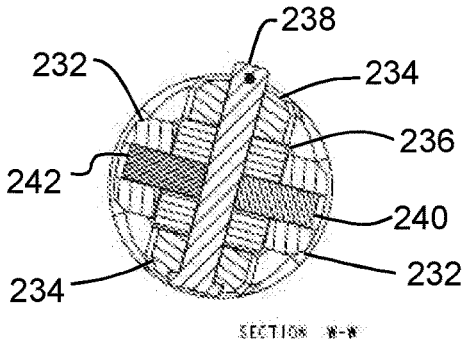
FIG. 17 shows a cross sectional view of the drive shaft, taken perpendicular to the principal axis of the drive shaft, along line W-W in FIG. 15.
Figure 18:
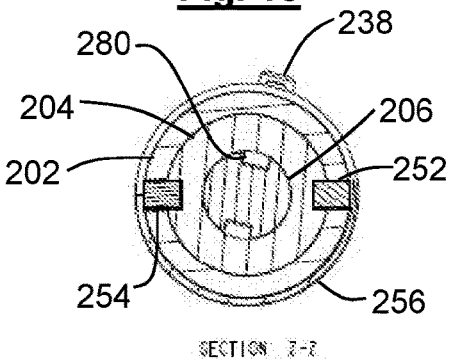
FIG. 18 shows a cross sectional view of the drive shaft, taken perpendicular to the principal axis of the drive shaft, along line Z-Z in FIG. 15.

FIG. 16 shows a cross sectional view of the drive shaft, taken perpendicular to the principal axis of the drive shaft, along line Y-Y in FIG. 15. FIG. 17 shows a cross sectional view of the drive shaft, taken perpendicular to the principal axis of the drive shaft, along line W-W in FIG. 15. FIG. 18 shows a cross sectional view of the drive shaft, taken perpendicular to the principal axis of the drive shaft, along line Z-Z in FIG. 15. The reference numbers used in these drawings are discussed with reference to FIG. 19.

Figure 20:
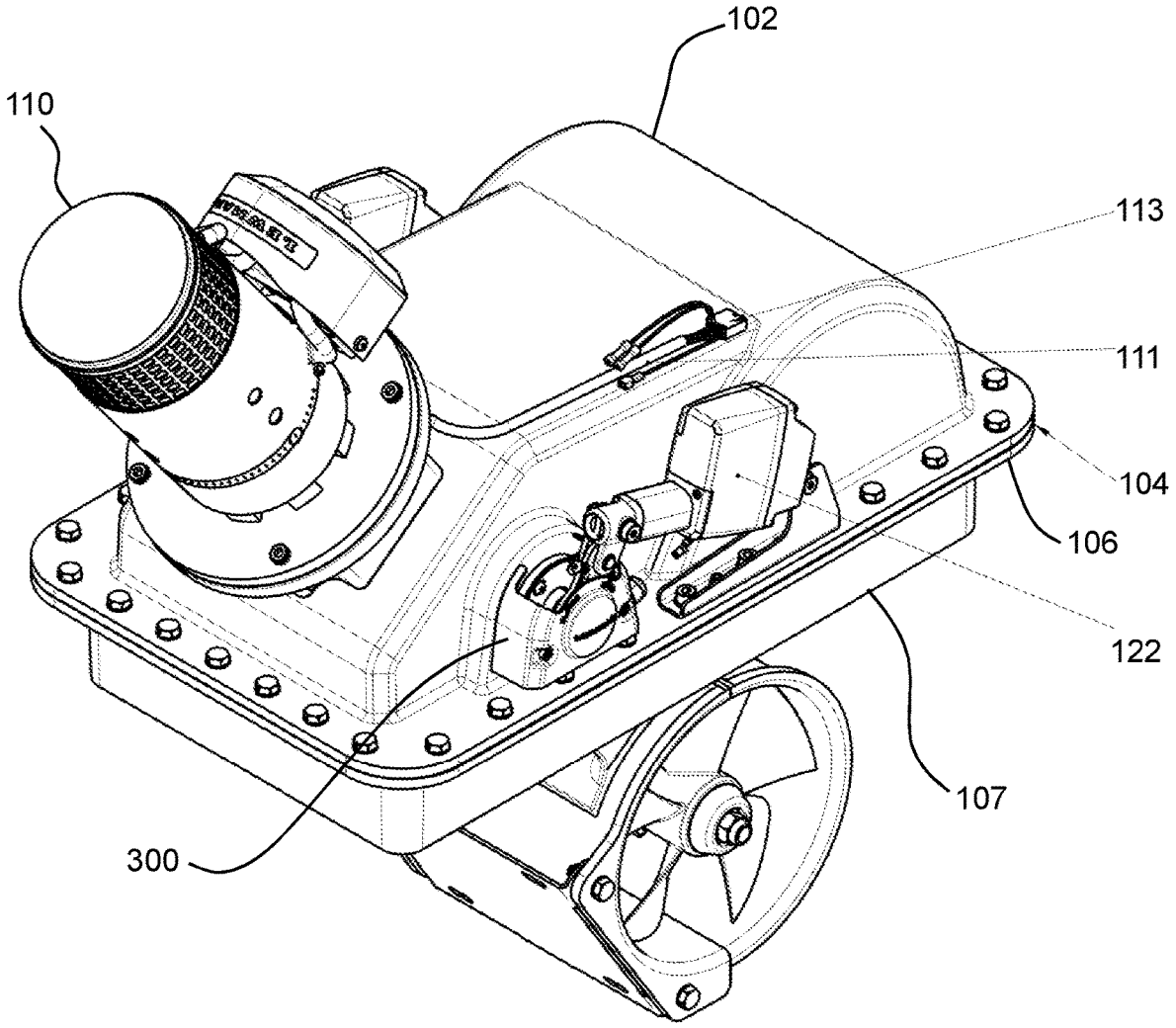
FIG. 20 shows a perspective view of a thruster assembly according to an embodiment of the present invention, viewed from above, with the assembly in the deployed configuration.

FIG. 20 shows a perspective view of a thruster assembly according to an embodiment of the present invention, viewed from above, with the assembly in the deployed configuration. The housing 102 of the assembly has a downwardly-facing bottom flange 104 intended to be fixed in a sealing engagement with a corresponding upwardly-facing flange 106 of an insert unit 107 located at an opening formed in a hull of a marine vessel. Together, the hull, insert unit 107 and housing 102 provide a watertight seal against ingress of water.

Figure 21:
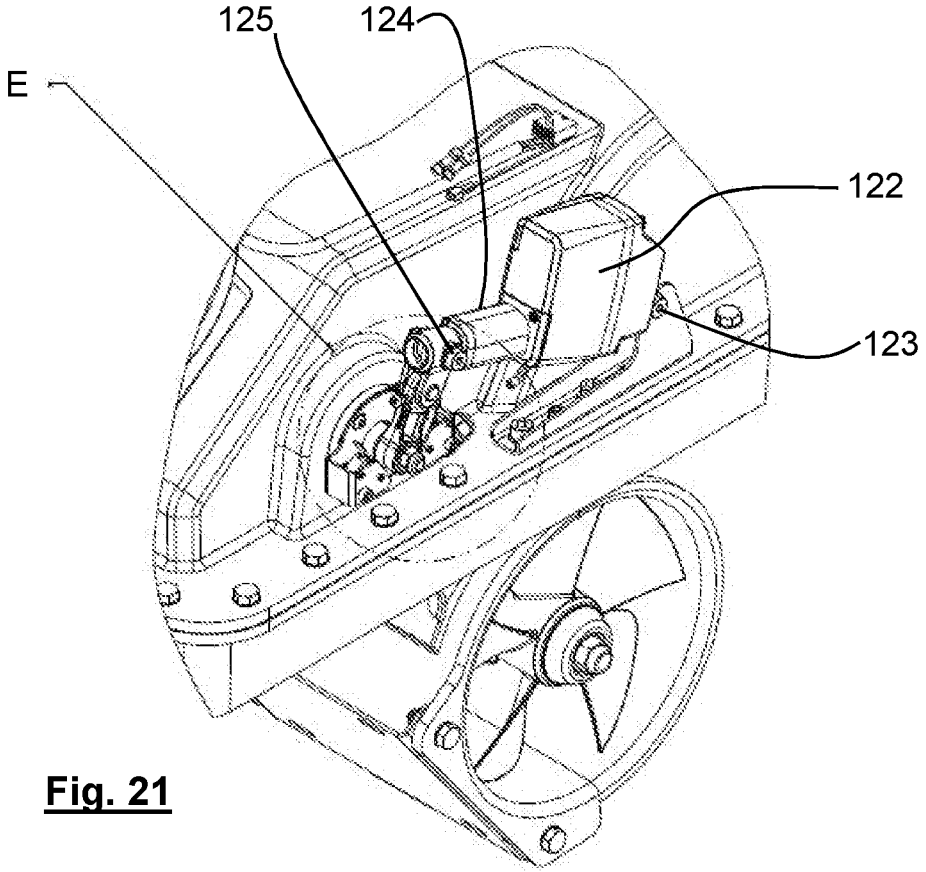
FIG. 21 shows a partial view corresponding to FIG. 20 but with a cover on the actuation mechanism removed.
Figure 22:
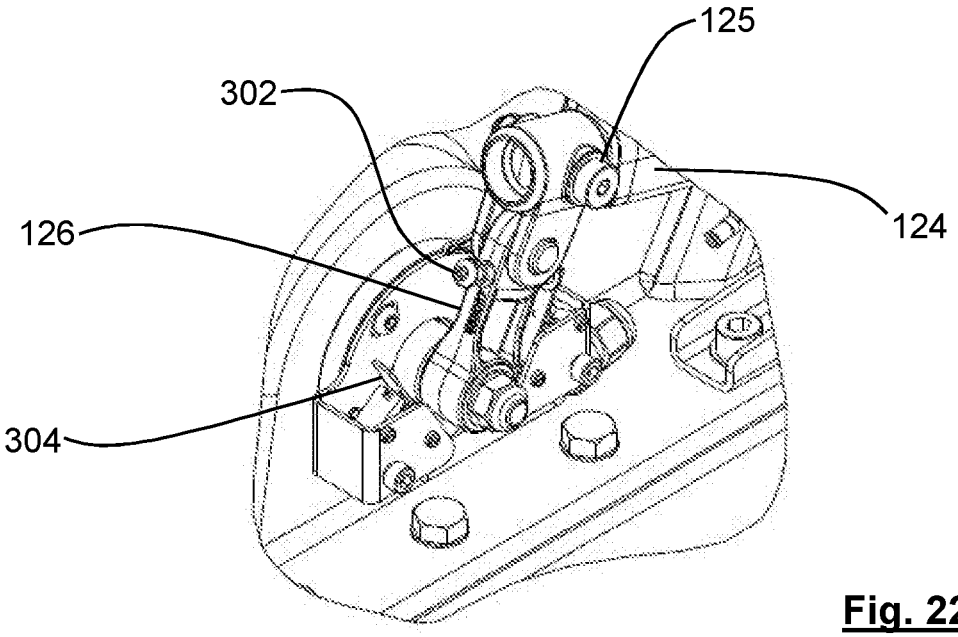
FIG. 22 shows an enlarged partial view corresponding to the region indicated in FIG. 21.

Motor 110 is fixed with respect to the housing 102, in a similar manner to the reference arrangement. Motor control cable 111 and junction 113 provide electrical connection to the motor. Actuator 122 is shown, with part of the actuation mechanism obscured by cover 300. FIG. 21 shows a partial view corresponding to FIG. 20 but with cover 300 on the actuation mechanism removed. FIG. 22 shows an enlarged partial view corresponding to the region indicated as E in FIG. 21.

Actuator 122 is pivotably attached with respect to the housing 102 at actuator pivot 123, the actuator 122 being operable to extend and retract actuator rod 124. Actuator rod 124 is pivotably attached at pivot 125 to crank 126. Crank 126 has lug 302 extending forwardly for pressing engagement with switch 304. At the limit of travel of the propeller unit to the deployment configuration (due to operation of the actuator mechanism to push actuator rod 124), lug 302 presses against switch 304. This permits the motor to the operated, due to the switch being ON. When the actuator is operated to move the propeller unit away from the deployment configuration towards the storage configuration, the lug 302 moves out of contact with the switch 304, the switch thereby being OFF. In this way, the motor can only be operated when the drive shaft is straight, reducing the risk of breakage of the drive shaft at one of the universal joints.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A retractable thruster assembly for a marine vessel comprising:

a propeller unit, a motor, a drive shaft linking the motor with the propeller unit to drive the propeller unit, a housing for locating the propeller unit in a storage configuration, the motor being fixed with respect to the housing, the housing being adapted to be fixed with respect to an opening in a hull of the marine vessel, an actuator operable to move the propeller unit from the storage configuration to a deployment configuration in a direction from inboard to outboard, the propeller unit being extended from the hull for use in the deployment configuration, wherein the drive shaft comprises a motor-side universal joint for attachment to the motor and a propeller-side universal joint for attachment to the propeller unit, the motor-side universal joint and the propeller-side universal joint permitting folding of the drive shaft at least in the storage configuration, the drive shaft further comprising:

a motor-side telescopic section disposed adjacent the motor-side universal joint;

a propeller-side telescopic section disposed adjacent the propeller-side universal joint;

at least one intermediate telescopic section disposed between the motor-side telescopic section and the propeller-side telescopic section, wherein the motor-side telescopic section, the intermediate telescopic section and the propeller-side telescopic section are substantially coaxial and slidable relative to each other to accommodate an increase in distance between the propeller unit and the motor when the propeller unit is moved from the storage configuration to the deployment configuration, the drive shaft being capable of transmitting torque from the motor to the propeller unit via the motor-side telescopic section, the intermediate telescopic section and the propeller-side telescopic section at least when the propeller unit is in the deployment configuration.

2. A retractable thruster assembly according to claim 1 wherein the propeller unit is supported by a support assembly which is pivotable relative to the housing about a pivot axis.

3. A retractable thruster assembly according to claim 2 wherein the drive shaft defines a drive path between the motor and the propeller unit, a closest point on the drive path being defined as a point on the drive path which is closest to the pivot axis, and wherein the pivot axis is located in a position which is outboard of the closest point on the drive path, when the propeller unit is in the storage configuration and when the propeller unit is in the deployment configuration.

4. A retractable thruster assembly according to claim 2 wherein the pivot axis is located in a position which is closer to the hull compared with distance between the hull and the closest point on the drive path, when the propeller unit is in the storage configuration and when the propeller unit is in the deployment configuration.

5. A retractable thruster assembly according to claim 2 wherein the housing has a flange configured to be fixed with respect to an opening in a hull of the marine vessel, and when the housing is oriented upright, the flange is downwards-facing, and the pivot axis is located in a position downwardly from the flange of the housing.

6. A retractable thruster assembly according to claim 1 wherein the actuator is operable to drive a rotatable actuator shaft, rotatable about an actuator shaft rotation axis, to move the propeller unit from the storage configuration to the deployment configuration in a direction from inboard to outboard.

7. A retractable thruster according to claim 6 wherein the actuator shaft extends through the housing via a watertight rotatable seal.

8. A retractable thruster assembly according to claim 1 which is configured to prevent operation of the motor to drive the propeller unless the propeller is in the deployment configuration.

9. A retractable thruster assembly according to claim 8 wherein the motor is subject to the control of a mechanical-electrical switch that is operated to be ON only when the propeller is in the deployment configuration.

10. A retractable thruster assembly according to claim 9 wherein the mechanical-electrical switch is operated between ON and OFF by operation of the actuator.

11. A retractable thruster assembly according to claim 1 wherein the propeller unit sits within a tunnel, and there is a cover, connected to the tunnel via a connecting means, arranged to cover the opening in the hull of the marine vessel, when the thruster assembly is in the storage configuration.

12. A marine vessel having a hull and a retractable thruster assembly located in the hull, the retractable thruster assembly comprising:

a propeller unit, a motor, a drive shaft linking the motor with the propeller unit to drive the propeller unit, a housing for locating the propeller unit in a storage configuration, the motor being fixed with respect to the housing, the housing being fixed with respect to an opening in the hull of the marine vessel, an actuator operable to move the propeller unit from the storage configuration to a deployment configuration in a direction from inboard to outboard, the propeller unit being extended from the hull for use in the deployment configuration, wherein the drive shaft comprises a motor-side universal joint for attachment to the motor and a propeller-side universal joint for attachment to the propeller unit, the motor-side universal joint and the propeller-side universal joint permitting folding of the drive shaft at least in the storage configuration, the drive shaft further comprising:

a motor-side telescopic section disposed adjacent the motor-side universal joint;

a propeller-side telescopic section disposed adjacent the propeller-side universal joint;

at least one intermediate telescopic section disposed between the motor-side telescopic section and the propeller-side telescopic section, wherein the motor-side telescopic section, the intermediate telescopic section and the propeller-side telescopic section are substantially coaxial and slidable relative to each other to accommodate an increase in distance between the propeller unit and the motor when the propeller unit is moved from the storage configuration to the deployment configuration, the drive shaft being capable of transmitting torque from the motor to the propeller unit via the motor-side telescopic section, the intermediate telescopic section and the propeller-side telescopic section at least when the propeller unit is in the deployment configuration.

13. A method for installing a retractable thruster into a marine vessel, the retractable thruster assembly comprising:

a propeller unit, a motor, a drive shaft linking the motor with the propeller unit to drive the propeller unit, a housing for locating the propeller unit in a storage configuration, the motor being fixed with respect to the housing, the housing being adapted to be fixed with respect to an opening in a hull of the marine vessel, an actuator operable to move the propeller unit from the storage configuration to a deployment configuration in a direction from inboard to outboard, the propeller unit being extended from the hull for use in the deployment configuration, wherein the drive shaft comprises a motor-side universal joint for attachment to the motor and a propeller-side universal joint for attachment to the propeller unit, the motor-side universal joint and the propeller-side universal joint permitting folding of the drive shaft at least in the storage configuration, the drive shaft further comprising:

a motor-side telescopic section disposed adjacent the motor-side universal joint;

a propeller-side telescopic section disposed adjacent the propeller-side universal joint;

at least one intermediate telescopic section disposed between the motor-side telescopic section and the propeller-side telescopic section, wherein the motor-side telescopic section, the intermediate telescopic section and the propeller-side telescopic section are substantially coaxial and slidable relative to each other to accommodate an increase in distance between the propeller unit and the motor when the propeller unit is moved from the storage configuration to the deployment configuration, the drive shaft being capable of transmitting torque from the motor to the propeller unit via the motor-side telescopic section, the intermediate telescopic section and the propeller-side telescopic section at least when the propeller unit is in the deployment configuration, the method including the step of providing an opening in the hull of the marine vessel and fixing the housing of the retractable thruster assembly with respect to the opening.

14. A method according to claim 13 wherein the method includes the step of bonding an insert unit into the hull of the vessel at the opening in the hull of the vessel, and the housing is fixed in a sealing engagement with the insert unit.

15. A kit of parts, comprising a retractable thruster assembly and an insert unit, the insert unit being for installation at a corresponding hole formed in a hull of a marine vessel, wherein the retractable thruster assembly comprises:

a propeller unit, a motor, a drive shaft linking the motor with the propeller unit to drive the propeller unit, a housing for locating the propeller unit in a storage configuration, the motor being fixed with respect to the housing, the housing being adapted to be fixed with respect to an opening in the hull of the marine vessel, an actuator operable to move the propeller unit from the storage configuration to a deployment configuration in a direction from inboard to outboard, the propeller unit being extended from the hull for use in the deployment configuration, wherein the drive shaft comprises a motor-side universal joint for attachment to the motor and a propeller-side universal joint for attachment to the propeller unit, the motor-side universal joint and the propeller-side universal joint permitting folding of the drive shaft at least in the storage configuration, the drive shaft further comprising:

a motor-side telescopic section disposed adjacent the motor-side universal joint;

a propeller-side telescopic section disposed adjacent the propeller-side universal joint;

at least one intermediate telescopic section disposed between the motor-side telescopic section and the propeller-side telescopic section, wherein the motor-side telescopic section, the intermediate telescopic section and the propeller-side telescopic section are substantially coaxial and slidable relative to each other to accommodate an increase in distance between the propeller unit and the motor when the propeller unit is moved from the storage configuration to the deployment configuration, the drive shaft being capable of transmitting torque from the motor to the propeller unit via the motor-side telescopic section, the intermediate telescopic section and the propeller-side telescopic section at least when the propeller unit is in the deployment configuration, and wherein the insert unit and the housing are adapted to be sealingly attached to each other.

* * * * *